US008776893B2

(12) United States Patent
Donald et al.

(10) Patent No.: US 8,776,893 B2
(45) Date of Patent: Jul. 15, 2014

(54) APPARATUS AND METHOD FOR PROCESSING FLUIDS FROM A WELL

(75) Inventors: Ian Donald, Aberdeenshire (GB); John Reid, Dundee (GB)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 13/591,443

(22) Filed: Aug. 22, 2012

(65) Prior Publication Data

US 2012/0312541 A1 Dec. 13, 2012

Related U.S. Application Data

(62) Division of application No. 12/515,729, filed as application No. PCT/US2007/084884 on Nov. 15, 2007, now Pat. No. 8,297,360.

(30) Foreign Application Priority Data

Dec. 18, 2006 (GB) ..... 0625526.9

(51) Int. Cl.
*E21B 7/12* (2006.01)

(52) U.S. Cl.
USPC ..... 166/347; 166/338; 166/341; 166/344; 166/351

(58) Field of Classification Search
USPC ..... 166/339, 345, 351, 352, 358, 367, 85.1, 166/85.5, 78.1, 241.6; 175/5, 7, 10
See application file for complete search history.

(56) References Cited

U.S. PATENT DOCUMENTS

| | | | |
|---|---|---|---|
| 1,758,376 | A | 5/1930 | Sawyer |
| 1,944,573 | A | 1/1934 | Williams et al. |
| 1,944,840 | A | 1/1934 | Humason |
| 1,994,840 | A | 3/1935 | Thoen |
| 2,132,199 | A | 10/1938 | Yancey |
| 2,233,077 | A | 2/1941 | Gillespie et al. |
| 2,276,883 | A | 3/1942 | Schon et al. |

(Continued)

FOREIGN PATENT DOCUMENTS

| | | |
|---|---|---|
| AU | 498216 | 4/1999 |
| BR | 10415841 | 3/2007 |

(Continued)

OTHER PUBLICATIONS

European Decision to Grant dated Mar. 15, 2012; European Application No. 01980737.9 (1 p.).

(Continued)

*Primary Examiner* — Matthew Buck
*Assistant Examiner* — Aaron Lembo
(74) *Attorney, Agent, or Firm* — Conley Rose, P.C.

(57) ABSTRACT

Provided is a system, including a first module (35*b*) configured to process fluid from a well, wherein the first module (35*b*) has an extension conduit (5*b*), having a connection that is coupleable to a central mandrel of a manifold (5), a processing device arranged in a region surrounding the extension conduit (5*b*), a processing input (18*a*), and a processing output (19*a*). Further provided is a method of processing well fluids, including diverting fluids from a bore of a manifold (1) to a processing module (35*b*), wherein the processing module (35*b*) is coupled to a mandrel of the manifold (5), processing the fluids in the processing module (35*b*), and returning the fluids to a flowpath (19*a*) for recovery.

38 Claims, 8 Drawing Sheets

(56) References Cited

U.S. PATENT DOCUMENTS 2,412,765 A 12/1946 Buddrus et al.
2,415,992 A 2/1947 Clair
2,790,500 A 4/1957 Jones
2,893,435 A 7/1959 Eichenberg
2,962,356 A 11/1960 Johns
3,101,118 A 8/1963 Culver et al.
3,163,224 A 12/1964 Haeber et al.
3,358,753 A 12/1967 Haeber
3,378,066 A 4/1968 Otteman et al.
3,593,808 A 7/1971 Nelson
3,595,311 A 7/1971 Harbonn et al.
3,603,409 A 9/1971 Watkins
3,608,631 A 9/1971 Sizer et al.
3,688,840 A 9/1972 Curington et al.
3,705,626 A 12/1972 Glenn, Jr. et al.
3,710,859 A 1/1973 Hanes et al.
3,753,257 A 8/1973 Arnold
3,777,812 A 12/1973 Burkhardt et al.
3,820,558 A 6/1974 Mueller
3,834,460 A 9/1974 Brun et al.
3,953,982 A 5/1976 Pennock
3,957,079 A 5/1976 Whiteman
4,042,033 A 8/1977 Holland et al.
4,046,191 A 9/1977 Neath
4,046,192 A 9/1977 Darnborough
4,095,649 A 6/1978 Chateau et al.
4,099,583 A 7/1978 Maus
4,102,401 A 7/1978 Erbstoesser
4,105,068 A 8/1978 Tam
4,120,362 A 10/1978 Chateau et al.
4,161,367 A 7/1979 Cuiper et al.
4,190,120 A 2/1980 Regan
4,210,208 A 7/1980 Shanks
4,223,728 A 9/1980 Pegg
4,260,022 A 4/1981 Van Bilderbeek
4,274,664 A 6/1981 Thominet
4,291,772 A 9/1981 Beynet
4,294,471 A 10/1981 Van Bilderbeek
4,347,899 A 9/1982 Weeter
4,401,164 A 8/1983 Baugh
4,403,658 A 9/1983 Watkins
4,405,016 A 9/1983 Best
4,444,275 A 4/1984 Beynet et al.
4,457,489 A 7/1984 Gilmore
4,478,287 A 10/1984 Hynes et al.
4,502,534 A 3/1985 Roche et al.
4,503,878 A 3/1985 Taylor
4,509,599 A 4/1985 Chenoweth et al.
4,572,298 A 2/1986 Weston
4,589,493 A 5/1986 Kelly et al.
4,607,701 A 8/1986 Gunderson
4,610,570 A 9/1986 Brockway
4,626,135 A 12/1986 Roche
4,629,003 A 12/1986 Baugh
4,630,681 A 12/1986 Iwamoto
4,646,844 A 3/1987 Roche et al.
4,695,190 A 9/1987 Best et al.
4,702,320 A 10/1987 Gano et al.
4,721,163 A 1/1988 Davis
4,756,368 A 7/1988 Ikuta et al.
4,813,495 A 3/1989 Leach
4,820,083 A 4/1989 Hall
4,830,111 A 5/1989 Jenkins et al.
4,832,124 A 5/1989 Rayson
4,848,471 A 7/1989 Bencze et al.
4,848,473 A 7/1989 Lochte
4,848,475 A * 7/1989 Dean et al. ..... 166/357
4,874,008 A 10/1989 Lawson
4,896,725 A 1/1990 Parker et al.
4,899,822 A 2/1990 Daeschler et al.
4,911,240 A 3/1990 Haney et al.
4,919,207 A 4/1990 Ikuta et al.
4,926,898 A 5/1990 Sampey
4,972,904 A 11/1990 Godare
5,010,956 A 4/1991 Bednar
5,025,865 A 6/1991 Caldwell
5,044,672 A 9/1991 Skeels
5,069,286 A 12/1991 Roensch
5,074,519 A 12/1991 Pettus
5,085,277 A 2/1992 Hopper
5,143,158 A 9/1992 Watkins
5,201,491 A 4/1993 Domangue
5,213,162 A 5/1993 Iato
5,248,166 A 9/1993 Wilkins
5,255,745 A 10/1993 Czyrek
5,280,766 A 1/1994 Mohn
5,295,534 A 3/1994 Porter
5,299,641 A 4/1994 Paulo
5,398,761 A 3/1995 Reynolds et al.
5,456,313 A 10/1995 Hopper
5,462,361 A 10/1995 Sato
5,492,436 A 2/1996 Suksumake
5,526,882 A 6/1996 Parks
5,535,826 A 7/1996 Brown
5,544,707 A 8/1996 Hopper
5,678,460 A 10/1997 Walkowc
5,719,481 A 2/1998 Mo
5,730,551 A 3/1998 Skeels
5,807,027 A 9/1998 Oestergaar
5,868,204 A 2/1999 Pritchett et al.
5,884,706 A 3/1999 Edwards
5,927,405 A 7/1999 Monjure
5,944,152 A 8/1999 Lindsay
5,971,077 A * 10/1999 Lilley ..... 166/368
5,988,282 A 11/1999 Jennings et al.
5,992,526 A 11/1999 Cunningham et al.
5,992,527 A * 11/1999 Garnham et al. ..... 166/379
6,039,119 A 3/2000 Hopper et al.
6,050,339 A 4/2000 Milberger
6,053,252 A 4/2000 Edwards
6,076,605 A 6/2000 Lilley
6,098,715 A 8/2000 Seixas
6,109,352 A 8/2000 Edwards
6,116,784 A 9/2000 Brotz
6,123,312 A 9/2000 Dai
6,138,774 A 10/2000 Bourgoyne, Jr.
6,145,596 A 11/2000 Dallas
6,182,761 B1 2/2001 Bednar
6,186,239 B1 2/2001 Monjure
6,209,650 B1 4/2001 Ingebrigtsen et al.
6,227,300 B1 5/2001 Cunningham
6,289,992 B1 9/2001 Monjure
6,296,453 B1 10/2001 Layman
6,321,843 B2 11/2001 Baker
6,352,114 B1 3/2002 Toalson et al.
6,367,551 B1 4/2002 Fenton
6,388,577 B1 5/2002 Carstensen
6,457,529 B2 10/2002 Calder
6,457,530 B1 10/2002 Lam
6,457,540 B2 10/2002 Gardes
6,460,621 B2 10/2002 Fenton
6,481,504 B1 11/2002 Gatherar
6,484,807 B2 11/2002 Allen
6,494,267 B2 12/2002 Allen
6,497,286 B1 12/2002 Hopper
6,554,075 B2 4/2003 Filkes et al.
6,557,629 B2 5/2003 Wong
6,612,368 B2 9/2003 Kent et al.
6,612,369 B1 9/2003 Rocha et al.
6,637,514 B1 10/2003 Donald
6,651,745 B1 11/2003 Lush
6,655,455 B2 12/2003 Bartlett et al.
6,675,900 B2 1/2004 Baskett et al.
6,698,520 B2 * 3/2004 Fenton et al. ..... 166/347
6,719,059 B2 4/2004 Dezen et al.
6,755,254 B2 6/2004 DeBerry
6,760,275 B2 7/2004 Carstensen
6,763,890 B2 7/2004 Polsky et al.
6,763,891 B2 7/2004 Humphrey et al.
6,805,200 B2 10/2004 DeBerry
6,823,941 B2 11/2004 Donald
6,840,323 B2 1/2005 Fenton
6,902,005 B2 6/2005 Radi et al.
6,907,932 B2 6/2005 Reimert

(56) References Cited

U.S. PATENT DOCUMENTS

| | | | | |
|---|---|---|---|---|
| 6,966,383 | B2 | 11/2005 | Millberger | |
| 6,968,902 | B2 | 11/2005 | Fenton | |
| 6,988,553 | B2 * | 1/2006 | DeBerry | 166/347 |
| 7,032,673 | B2 | 4/2006 | Dezen | |
| 7,040,408 | B2 | 5/2006 | Sundararajan | |
| 7,069,995 | B2 | 7/2006 | Chan | |
| 7,073,592 | B2 | 7/2006 | Polsky et al. | |
| 7,111,687 | B2 | 9/2006 | Donald | |
| 7,201,229 | B2 | 4/2007 | White | |
| 7,210,530 | B2 | 5/2007 | Lush | |
| 7,243,729 | B2 | 7/2007 | Tyrrell et al. | |
| 7,270,185 | B2 | 9/2007 | Fontana | |
| 7,331,396 | B2 * | 2/2008 | Reimert et al. | 166/368 |
| 7,363,982 | B2 | 4/2008 | Hopper | |
| 7,569,097 | B2 | 8/2009 | Campen | |
| 7,658,228 | B2 | 2/2010 | Moksvold | |
| 7,699,099 | B2 | 4/2010 | Bolding | |
| 7,718,676 | B2 | 5/2010 | Moussey | |
| 7,740,074 | B2 | 6/2010 | White | |
| 7,757,772 | B2 | 7/2010 | Donohue | |
| 7,770,653 | B2 | 8/2010 | Hill | |
| 7,823,648 | B2 | 11/2010 | Bolding | |
| 7,828,064 | B2 * | 11/2010 | Robichaux et al. | 166/358 |
| 7,909,103 | B2 | 3/2011 | Fenton | |
| 8,011,436 | B2 | 9/2011 | Christie et al. | |
| 8,066,076 | B2 * | 11/2011 | Donald et al. | 166/344 |
| 8,118,102 | B2 * | 2/2012 | Robichaux et al. | 166/345 |
| 2001/0011593 | A1 * | 8/2001 | Wilkins | 166/368 |
| 2001/0050185 | A1 | 12/2001 | Calder et al. | |
| 2002/0000315 | A1 | 1/2002 | Kent et al. | |
| 2002/0070026 | A1 * | 6/2002 | Fenton et al. | 166/368 |
| 2002/0074123 | A1 | 6/2002 | Regan | |
| 2003/0010498 | A1 | 1/2003 | Tolman et al. | |
| 2003/0019632 | A1 | 1/2003 | Humphrey et al. | |
| 2003/0145997 | A1 | 8/2003 | Langford et al. | |
| 2003/0146000 | A1 | 8/2003 | Dezen et al. | |
| 2004/0026084 | A1 | 2/2004 | Donald | |
| 2004/0057299 | A1 | 3/2004 | Kozakai et al. | |
| 2004/0154790 | A1 | 8/2004 | Cornelssen et al. | |
| 2004/0154800 | A1 | 8/2004 | Jack et al. | |
| 2004/0200620 | A1 | 10/2004 | Ostergaard | |
| 2004/0206507 | A1 | 10/2004 | Bunney | |
| 2004/0251030 | A1 | 12/2004 | Appleford et al. | |
| 2005/0028984 | A1 | 2/2005 | Donald et al. | |
| 2005/0058535 | A1 | 3/2005 | Meshenky et al. | |
| 2005/0109514 | A1 | 5/2005 | White et al. | |
| 2005/0121198 | A1 * | 6/2005 | Andrews | 166/368 |
| 2005/0173322 | A1 | 8/2005 | Ostergaard | |
| 2005/0263194 | A1 | 12/2005 | Tseng et al. | |
| 2006/0237194 | A1 | 10/2006 | Donald et al. | |
| 2007/0144743 | A1 | 6/2007 | White et al. | |
| 2008/0047714 | A1 | 2/2008 | McMiles | |
| 2008/0128139 | A1 | 6/2008 | White | |
| 2008/0169097 | A1 | 7/2008 | Bolding et al. | |
| 2008/0277122 | A1 | 11/2008 | Tinnen | |
| 2008/0302535 | A1 | 12/2008 | Barnes | |
| 2009/0025936 | A1 | 1/2009 | Donald et al. | |
| 2009/0126938 | A1 | 5/2009 | White | |
| 2009/0260831 | A1 | 10/2009 | Moksvold | |
| 2009/0266542 | A1 | 10/2009 | Donald et al. | |
| 2009/0266550 | A1 | 10/2009 | Fenton | |
| 2009/0294125 | A1 | 12/2009 | Donald et al. | |
| 2009/0294132 | A1 | 12/2009 | Donald et al. | |
| 2009/0301727 | A1 | 12/2009 | Donald et al. | |
| 2009/0301728 | A1 | 12/2009 | Donald et al. | |
| 2010/0018693 | A1 | 1/2010 | Duncan et al. | |
| 2010/0025034 | A1 | 2/2010 | Donald et al. | |
| 2010/0044038 | A1 | 2/2010 | Donald et al. | |
| 2010/0206546 | A1 | 8/2010 | Donald et al. | |
| 2010/0206547 | A1 | 8/2010 | Donald et al. | |
| 2010/0206576 | A1 | 8/2010 | Donald et al. | |
| 2010/0300700 | A1 * | 12/2010 | Garbett et al. | 166/368 |
| 2011/0192609 | A1 | 8/2011 | Tan et al. | |
| 2012/0273214 | A1 * | 11/2012 | Donald et al. | 166/344 |

FOREIGN PATENT DOCUMENTS

| | | | |
|---|---|---|---|
| CH | 638019 | 8/1983 | |
| DE | 2541715 | 4/1976 | |
| DE | 3738424 | 5/1989 | |
| EP | 0036213 | 9/1981 | |
| EP | 0568742 | 11/1993 | |
| EP | 0572732 | 12/1993 | |
| EP | 0719905 | 3/1996 | |
| EP | 0841464 | 5/1998 | |
| EP | 1990505 | 9/2002 | |
| EP | 1639230 | 1/2009 | |
| EP | 1918509 | 10/2009 | |
| FR | 2710946 | 4/1995 | |
| GB | 242913 | 11/1925 | |
| GB | 1022352 | 3/1966 | |
| GB | 2197675 | 5/1998 | |
| GB | 2319795 | 6/1998 | |
| GB | 2346630 | 8/2000 | |
| GB | 2361726 | 10/2001 | |
| GB | 0312543.2 | 5/2003 | |
| GB | 0405454.0 | 3/2004 | |
| GB | 0405471.4 | 3/2004 | |
| GB | 2445493 | 7/2008 | |
| NO | 20061778 | 5/2006 | |
| WO | 90/08897 | 8/1990 | |
| WO | 96/30625 | 10/1996 | |
| WO | 98/15712 | 4/1998 | |
| WO | 99/06731 | 2/1999 | |
| WO | 99/28593 | 6/1999 | |
| WO | 99/49173 | 9/1999 | |
| WO | 00/47864 | 8/2000 | |
| WO | 00/53937 | 9/2000 | |
| WO | 00/70185 | 11/2000 | |
| WO | 02/38912 | 5/2002 | |
| WO | 02/088519 | 11/2002 | |
| WO | 03/033868 | 4/2003 | |
| WO | 03/078793 | 9/2003 | |
| WO | 2005/040545 | 5/2005 | |
| WO | 2005/047646 | 5/2005 | |
| WO | 2005/083228 | 9/2005 | |
| WO | WO 2005083228 A1 * | 9/2005 | E21B 33/035 |
| WO | 2006/041811 | 4/2006 | |
| WO | 2007/079137 | 7/2007 | |
| WO | 2008/034024 | 3/2008 | |

OTHER PUBLICATIONS

European Response to Office Action Dated Nov. 14, 2011; European Application No. 05781685.2; Response filed May 22, 2012 (3 p.).

U.S. Corrected Notice of Allowability dated Jun. 8, 2012; U.S. Appl. No. 12/768,324 (10 p.).

Australian Response to Office Action; Australian Application No. 2011200165I Response Filed Jun. 20, 2012 (124 p.).

European Office Action dated Feb. 7, 2012; European Application No. 07864482.0 (8 p.).

U.S. Office Action dated Jul. 20, 2012; U.S. Appl. No. 13/164,291 (71 p.).

European Response to Office Action Dated Feb. 17, 2012; Application No. 07864482.0; Response Filed Aug. 9, 2012 (10 p.).

European Search Report and Opinion Dated Aug. 6, 2012; Application No. 12003132.3 (7 p.).

Canadian Office Action Dated Aug. 8, 2012; Canadian Application No. 2,526,714 (2 p.).

U.S. Office Action dated Sep. 4, 2012; U.S. Appl. No. 13/415,635 (5 p.).

U.S. Office Action dated Oct. 3, 2012; U.S. Appl. No. 13/536,433 (9 p.).

U.S. Office Action dated Oct. 12, 2012; U.S. Appl. No. 13/205,284 (9 p.).

U.S. Office Action dated Nov. 6, 2012; U.S. Appl. No. 13/405,997 (12 p.).

U.S. Response to Office Action Dated Jul. 20, 2012; U.S. Appl. No. 13/167,291; Response Filed Nov. 15, 2012 (13 p.).

U.S. Response to Office Action Dated Sep. 4, 2012; U.S. Appl. No. 13/415,635; Response Filed Dec. 4, 2012 (7 p.).

(56) References Cited

OTHER PUBLICATIONS

LaFitte, J.L., et al., "Dalia Subsea Production System: Presentation and Challenges," (OTC 18541) 2007 Offshore Technology Conference, Houston, Texas Apr. 30-May 3, 2007 (10 p.).
Dalia Brochure, Total S.A., Feb. 2007, France (98 p.).
Australian Examination Report dated Jul. 3, 2003; Application No. 47694/00 (2 p.).
Australian Response to Examination Report; Application No. 47694/00; Response filed Jul. 5, 2004 (20 p.).
Australian Examination Report dated Jul. 21, 2006; Application No. 2002212525 (2 p.).
Australian Response to Examination Report; Application No. 2002212525; Response filed Jun. 22, 2007 (33 p.).
Australian Examiner's Report dated Sep. 14, 2010; Application No. 2004289864 (2 p.).
Australian Response to Examiner's Report; Application No. 2004289864; Response filed Dec. 7, 2010 (23 p.).
Australian Examiner's Report No. 3 dated Dec. 13, 2010; Application No. 2004289864 (1 p.).
Brazilian Examination Report dated Apr. 3, 2008; Application No. PI0115157-6 (3 p.).
Response to Brazilian Examination Report; Application No. PI0115157-6; Response filed Jul. 21, 2008 (7 p.).
Canadian Office Action dated Jan. 10, 2007; Application No. 2,373,164 (2 p.).
Response to Canadian Office Action; Application No. 2,373,164; Response filed Jul. 10, 2007 (16 p.).
Canadian Office Action dated Oct. 12, 2007; Application No. 2,428,165 (2 p.).
Response to Canadian Office Action; Application No. 2,428,165; Response filed Jan. 3, 2008 (16 p.).
Canadian Office Action dated Dec. 6, 2010; Application No. 2,526,714 (3 p.).
EP Preliminary Examination Report & Written Opinion dated Sep. 4, 2001; PCT/GB00/01785 (17 p.).
Supplemental Notice of Allowance dated Jul. 7, 2011; U.S. Appl. No. 10/558,593 (7p.).
Provisional Application filed Feb. 26, 2004; U.S. Appl. No. 60/548,727 (36 p.).
U.S. Office Action dated Mar. 25, 2004; U.S. Appl. No. 10/415,156 (6 p.).
Response to Office Action dated Mar. 25, 2004; U.S. Appl. No. 10/415,156 (9 p.).
Notice of Allowance dated Jul. 26, 2004; U.S. Appl. No. 10/415,156 (4 p.).
U.S. Office Action dated Dec. 20, 2005; U.S. Appl. No. 10/651,703 (8 p.).
Response to Office Action dated Dec. 20, 2005; U.S. Appl. No. 10/651,703 (13 p.).
Notice of Allowance dated Apr. 26, 2006; U.S. Appl. No. 10/651,703 (7 p.).
Response to Notice of Allowance dated Apr. 26, 2006; U.S. Appl. No. 10/151,703 (7 p.).
Provisional Application filed Nov. 19, 2007; U.S. Appl. No. 61/190,048 (24 p.).
U.S. Office Action (Restriction Requirement) dated Feb. 11, 2008; U.S. Appl. No. 10/558,593 (7 p.).
Response to Office Action (Restriction Requirement) dated Feb. 11, 2008; U.S. Appl. No. 10/558,593 (12 p.).
U.S. Office Action (Restriction Requirement) dated Jul. 10, 2008; U.S. Appl. No. 10/558,593 (6 p.).
Response to Office Action (Restriction Requirement) dated Jul. 10, 2008; U.S. Appl. No. 10/558,593 (12 p.).
U.S. Office Action dated Jan. 8, 2009; U.S. Appl. No. 10/558,593 (8 p.).
Response to Office Action dated Jan. 8, 2009; U.S. Appl. No. 10/558,593 (31 p.).
Final Office Action dated Jul. 7, 2009; U.S. Appl. No. 10/558,593 (6 p.).
Response to Final Office Action dated Jul. 7, 2009; U.S. Appl. No. 10/558,593 (26 p.).
Office Action (Restriction Requirement) dated Jan. 7, 2010; U.S. Appl. No. 12/541,934 (5 p.).
Response to Office Action dated Jan. 7, 2010; U.S. Appl. No. 12/541,934 (6 p.).
U.S. Office Action dated Jul. 21, 2010; U.S. Appl. No. 10/558,593 (10 p.).
Response to Office Action dated Jul. 21, 2010; U.S. Appl. No. 10/558,593 (9 p.).
Office Action dated Aug. 12, 2010; U.S. Appl. No. 12/441,119 (14 p.).
Response to Office Action dated Aug. 12, 2010; U.S. Appl. No. 12/441,119; Response filed Nov. 8, 2010 (12 p.).
U.S. Office Action dated Aug. 31, 2010; U.S. Appl. No. 10/590,563 (13 p.).
Response to Office Action dated Aug. 31, 2010; U.S. Appl. No. 10/590,563; Response filed Nov. 29, 2010 (8 p.).
U.S. Office Action dated Oct. 6, 2010; U.S. Appl. No. 12/541,938 (7 p.).
Response to Office Action dated Oct. 6, 2010; U.S. Appl. No. 12/541,938; Response filed Jan. 11, 2011 (8 p.).
Office Action dated Dec. 7, 2010; U.S. Appl. No. 12/541,936 (12 p.).
Response to Office Action dated Dec. 7, 2010; U.S. Appl. No. 12/541,936; Response filed Jan. 20, 2011 (9 p.).
Notice of Allowance dated Jan. 6, 2011; U.S. Appl. No. 10/558,593 (26 p.).
Final Office Action dated Feb. 3, 2011; U.S. Appl. No. 12/441,119 (12 p.).
Office Action dated Feb. 16, 2011; U.S. Appl. No. 12/541,937 (7 p.).
Final Office Action dated Mar. 2, 2011; U.S. Appl. No. 10/590,563 (7 p.).
Response to Final Office Action dated Mar. 2, 2011; U.S. Appl. No. 10/590,563; Response filed Apr. 26, 2011 (8 p.).
Norwegian Office Action dated Mar. 28, 2011; Application No. 20015431 (3 p.).
Response to Final Office Action dated Feb. 3, 2011; U.S. Appl. No. 12/441,119; Response filed Mar. 30, 2011 (11 p.).
Final Office Action dated Mar. 30, 2011; U.S. Appl. No. 12/541,938 (5 p.).
Response to Final Office Action dated Mar. 30, 2011; U.S. Appl. No. 12/541,938; Response filed Apr. 18, 2011 (10 p.).
Notice of Allowance dated Apr. 1, 2011; U.S. Appl. No. 12/541,936 (5 p.).
Notice of Allowance dated Apr. 4, 2011; U.S. Appl. No. 10/558,593 (5 p.).
U.S. Office Action dated Apr. 13, 2011; U.S. Appl. No. 12/441,119 (10 p.).
Office Action Dated Apr. 14, 2011; U.S. Appl. No. 12/768,324 (7 p.).
Office Action Dated Apr. 28, 2011; U.S. Appl. No. 12/768,332 (6 p.).
Notice of Allowance Dated May 6, 2011; U.S. Appl. No. 12/541,938 (5 p.).
U.S. Office Action/Advisory Action dated May 6, 2011; U.S. Appl. No. 10/590,563 (3p.).
U.S. Office Action dated May 25, 2011; U.S. Appl. No. 12/515,534 (7p.).
Supplemental Notice of Allowance dated Jun. 8, 2011; U.S. Appl. No. 12/541,936 (2p.).
Notice of Allowance dated Jun. 28, 2011; U.S. Appl. No. 10/590,563 (14p.).
Response to Office Action dated Dec. 6, 2010; Canadian Application No. 2,526,714; Response filed Jun. 6, 2011 (16p.).
Response to Search Opinion; European Application No. 10185612.8; Response filed Jun. 29, 2011 (13p.).
European International Search Report dated Mar. 4, 2002; PCT/GB01/04940 (3 p.).
European Official Communication dated Mar. 5, 2003; Application No. 00929690.6 (2 p.).
European Response to Official Communication; Application No. 00929690.6; Response filed Jun. 27, 2003 (5 p.).
European Official Communication dated Aug. 29, 2003; Application No. 00929690.6 (3 p.).

(56) References Cited

OTHER PUBLICATIONS

European Examination Report dated Apr. 28, 2004; Application No. 00929690.6 (3 p.).
European Response to Examination Report; Application No. 00929690.6; Response filed Aug. 30, 2004 (20 p.).
European Communication dated Sep. 19, 2006; Application No. 01980737.9 (1 p.).
European Response to EPO Communication; Application No. 01980737.9; Response filed Oct. 6, 2006 (5 p.).
European Article 96(2) Communication dated Feb. 5, 2007; Application No. 04735596.1 (6 p.).
European Response to Examination Report; Application No. 047355961; Response filed Aug. 14, 2007 (15 p.).
European Search Report dated Apr. 16, 2007; Application No. 06024001.7 (2 p.).
European Article 96(2) Communication dated Jun. 12, 2007; Application No. 05717806.3 (3 p.).
European Response to Article 96(2) Communication dated Jun. 12, 2007; Application No. 05717806.3; Response filed Sep. 19, 2007 (17 p.).
European Examination Report dated Jun. 15, 2007; Application No. 01980737.9 (5 p.).
Response to European Examination Report dated Jun. 15, 2007; Application No. 01980737.9; Response filed Oct. 9, 2007 (12 p.).
European Examination Report dated Nov. 22, 2007; Application No. 04735596.1 (3 p.).
European Response to Examination Report dated Nov. 22, 2007; Application No. 04735596.1; Response filed Feb. 19, 2008 (101 p.).
European Examination Report dated Dec. 13, 2007; Application No. 06024001.7 (1 p.).
Response to European Examination Report dated Dec. 13, 2007; Application No. 06024001.7; Response filed Mar. 10, 2008 (6 p.).
European Search Report dated Mar. 28, 2008; Application No. 08000994.7 (4 p.).
European Response to Written Opinion dated Aug. 8, 2008; Application No. 08000994.7 (10 p.).
European Examination Report dated Oct. 30, 2008; Application No. 08000994.7 (2 p.).
European Response to Examination Report dated Oct. 30, 2008 w/amended specification; Application No. 08000994.7; Response filed Dec. 11, 2008 (94 p.).
European Examination Report dated May 18, 2009; Application No. 08162149.2 (8 p.).
European Response to Examination Report dated May 18, 2009; Application No. 08162149.2; Response filed Nov. 18, 2009 (132 p.).
Response to Article 94(3) and Rule 71(1) dated May 18, 2009; Application No. 08162149.2 (3 p.).
European Examination Report dated May 4, 2010; Application No. 07864486.1 (3 p.).
European Response to Examination Report dated May 4, 2010; Application No. 07864486.1; Response filed Nov. 12, 2010 (10 p.).
European Examination Report dated May 4, 2010; Application No. 07864482.0 (3 p.).
European Search Report dated Jun. 25, 2010; Application No. 10161116 (2 p.).
European Search Report dated Jun. 25, 2010; Application No. 10161117 (2 p.).
European Search Report dated Jun. 25, 2010; Application No. 10161120 (2 p.).
European Search Report dated Aug. 2, 2010; Application No. 10161117.6 (1 p.).
European Response to Examination Report dated Aug. 2, 2010; Application No. 10161117.6; Response filed Dec. 2, 2010 (6 p.).
European Examination Report dated Aug. 2, 2010; Application No. 10161116.8 (1 p.).
European Response to Examination Report dated Aug. 2, 2010; Application No. 10161116..8; Response filed Dec. 2, 2010 (13 p.).
European Examination Report dated Aug. 4, 2010; Application No. 10161120.0 (1 p.).
European Response to Examination Report dated Aug. 4, 2010; Application No. 10161120.0; Response filed Dec. 2, 2010 (6 p.).
European Examination Report dated Oct. 14, 2010; Application No. 10167181.6 (3 p.).
Response to European Examination Report dated Oct. 14, 2010; Application No. 10167181.6; Response filed Feb. 9, 2011 (6 p.).
European Examination Report dated Oct. 14, 2010; Application No. 10167183.2 (3 p.).
Response to European Examination Report dated Oct. 14, 2010; Application No. 10167183.2; Response filed Feb. 14, 2011 (4 p.).
European Examination Report dated Oct. 14, 2010; Application No. 10167182.4 (3 p.).
Response to European Examination Report dated Oct. 14, 2010; Application No. 10167182.4; Response filed Feb. 10, 2011 (6 p.).
European Examination Report dated Oct. 14, 2010; Application No. 10167184.0 (3 p.).
Response to European Examination Report dated Oct. 14, 2010; Application No. 10167184.0; Response filed Feb. 10, 2011 (8 p.).
European Examination Report dated Nov. 10, 2010; Application No. 07842464.5 (3 p.).
Response to European Examination Report dated Nov. 10, 2010; Application No. 07842464.5; Response filed Mar. 18, 2011 (11 p.).
European Search Report and Opinion dated Dec. 3, 2010; Application No. 10185795.1 (4 p.).
European Search Report dated Dec. 9, 2010; Application No. 10013192 (3 p.).
U.S. Final Office Action Dated Dec. 24, 2012; U.S. Appl. No. 13/164,291 (6 p.).
U.S. Response to Office Action Dated Oct. 12, 2012; U.S. Appl. No. 13/205,284; Response Filed Jan. 14, 2013 (8 p.).
U.S. Response to Office Action Dated Nov. 6, 2012; U.S. Appl. No. 13/405,997; Response Filed Feb. 5, 2013 (13 p.).
U.S. Response to Final Office Action Dated Dec. 24, 2012; U.S. Appl. No. 13/164,291; Response Filed Feb. 25, 2013 (7 p.).
U.S. Final Office Action Dated Mar. 6, 2013; U.S. Appl. No. 13/205,284 (11 p.).
U.S. Office Action Dated Mar. 6, 2013; U.S. Appl. No. 13/415,635 (18 p.).
U.S. Final Office Action Dated Mar. 6, 2013; U.S. Appl. No. 13/536,433 (15 p.).
Notice of Allowance Dated Mar. 7, 2013; U.S. Appl. No. 13/164,291 (9 p.).
U.S. Final Office Action Dated Apr. 8, 2013; U.S. Appl. No. 13/405,997 (15 p.).
U.S. Response to Final Office Action Dated Mar. 6, 2013; U.S. Appl. No. 13/205,284; Response Dated May 6, 2013 (11 p.).
U.S. Response to Final Office Action Dated Mar. 6, 2013; U.S. Appl. No. 13/536,433; Response Dated May 6, 2013 (26 p.).
U.S. Response to Office Action Dated Mar. 6, 2013; U.S. Appl. No. 13/415,635; Response Dated Jun. 6, 2013 (14p.).
U.S. Response to Final Office Action Dated Mar. 6, 2013; U.S. Appl. No. 13/536,433; Response Dated Jun. 6, 2013 (11 p.).
U.S. Response to Final Office Action Dated Apr. 8, 2013; U.S. Appl. No. 13/405,997; Response Filed Jun. 12, 2013 (18 p.).
Canadian Notice of Allowance dated May 30, 2013; Canadian Application No. 2,526,714 (1 p.).
U.S. Notice of Allowance dated Jun. 20, 2013; U.S. Appl. No. 13/536,433 (11 p.).
U.S. Office Action Dated Jul. 17, 2013; U.S. Appl. No. 13/687,290 (6 p.).
European Response to Office Action dated Sep. 10, 2012; Response Dated Jun. 14, 2013; European Application No. 12003132.3 (13 p.).
European Decision to Grant dated Jul. 15, 2013; European Application No. 10161117.6 (5 p.).
European Decision to Grant dated Jul. 15, 2013; European Application No. 101611200 (5 p.).
U.S. Supplemental Notice of Allowability dated Aug. 27, 2013; U.S. Appl. No. 13/536,433 (6 p.).
U.S. Notice of Allowance dated Sep. 5, 2013; U.S. Appl. No. 13/205,284 (10 p.).
European Office Action dated Aug. 21, 2013; European Application No. 07864486.1 (5 p.).

(56) References Cited

OTHER PUBLICATIONS

Norwegian Office Action dated Aug. 5, 2013; Norwegian Application No. 20110509 (3 p.).
U.S. Final Office Action dated Sep. 12, 2013; U.S. Appl. No. 13/415,635 (17 p.).
U.S. Final Office Action dated Sep. 16, 2013; U.S. Appl. No. 13/267,039 (11 p.).
European Decision to Grant dated Sep. 26, 2013; European Application No. 10167181.6 (2 p.).
U.S. Supplemental Notice of Allowability dated Oct. 8, 2013; U.S. Appl. No. 13/205,284 (6 p.).
U.S. Supplemental Notice of Allowability dated Oct. 11, 2013; U.S. Appl. No. 13/405,997 (6 p.).
European Decision to Grant dated Sep. 19, 2013; European Application No. 10185612.8 (2 p.).
European Decision to Grant dated Sep. 5, 2013; European Application No. 10167183.2 (2 p.).
U.S. Response to Final Office Action Dated Sep. 12, 2013; U.S. Appl. No. 13/415,635; Response Filed Nov. 12, 2013 (14 p.).
European Office Action dated Sep. 10, 2013; European Application No. 10013192.9 (1 p.).
U.S. Response to Final Office Action Dated Sep. 16, 2013; U.S. Appl. No. 13/267,039; Response Filed Nov. 18, 2013 (11 p.).
U.S. Response to Office Action Dated Jul. 19, 2013; U.S. Appl. No. 13/687,290; Response Filed Nov. 19, 2013 (17 p.).
U.S. Response to Final Office Action Dated Sep. 12, 2013 and Advisory Action Dated Nov. 25, 2013; U.S. Appl. No. 13/415,635; Response Filed Dec. 13, 2013 (12 p.).
U.S. Response to Final Office Action Dated Sep. 16, 2013 and Advisory Action Dated Dec. 11, 2013; U.S. Appl. No. 13/267,039; Response Filed Dec. 16, 2013 (8 p.).
U.S. Notice of Allowance Dated Jan. 14, 2014; U.S. Appl. No. 13/687,290 (8 p.).
U.S. Notice of Allowance Dated Jan. 27, 2014; U.S. Appl. No. 13/267,039 (5 p.).
Examination Report dated Jun. 30, 2011; European Application No. 10161116.8 (2p.).
Examination Report dated Jun. 30, 2011; European Application No. 10161117.6 (2p.).
Examination Report dated Jun. 30, 2011; European Application No. 10161120.0 (2p.).
Examination Report dated Jun. 30, 2011; European Application No. 10167181.6 (2p.).
Examination Report dated Jun. 30, 2011; European Application No. 10167182.4 (2p.).
Examination Report dated Jun. 30, 2011; European Application No. 10167183.2 (2p.).
Examination Report dated Jun. 30, 2011; European Application No. 10167184.0 (2p.).
Supplemental Notice of Allowance dated Jul. 7, 2011; Application No. 10/558,593 (7p.).
Response to Office Action dated Apr. 14, 2011; U.S. Appl. No. 12/768,324; Response filed Jul. 14, 2011 (7p.).
Response to Office Action dated Apr. 28, 2011; U.S. Appl. No. 12/768,332 (7 p.).
Notice of Allowance dated Jul. 22, 2011; U.S. Appl. No. 12/441,119 (15 p.).
European Search Report dated Dec. 2, 2010; European Application No. 10185612.8 (4 p.).
Norwegian Response to Office Action dated Jun. 22, 2011; Application No. 20015431 (19p.).
European Response to Search Opinion; Application No. 10185795.1; Response filed Aug. 3, 2011 (12 p.).
U.S. Office Action dated Jul. 21, 2011; U.S. Appl. No. 12/515,729 (53 p.).
Supplemental Notice of Allowance dated Aug. 8, 2011; U.S. Appl. No. 12/441,119 (9 p.).
Summons to Oral Proceedings dated Aug. 3, 2011; European Application No. 01980737.9 (3 p.).
European Response to Search Opinion; European Application No. 10013192.9; Response filed Aug. 10, 2011 (10 p.).
Notice of Allowability dated Aug. 26, 2011; U.S. Appl. No. 10/590,563 (11 p.).
European Office Action dated Aug. 22, 2011; Application No. 10185612.8 (2 p.).
U.S. Final Office Action dated Sep. 7, 2011; U.S. Appl. No. 12/541,937 (13 p.).
European Response to Oral Summons dated Sep. 22, 2011; EP Application No. 01980737.9 (42 p.).
Supplemental Notice of Allowance dated Oct. 11, 2011; U.S. Appl. No. 12/441,119 (8 p.).
Office Action dated Oct. 17, 2011; U.S. Appl. No. 12/768,337 (64 p.).
Notice of Allowance dated Oct. 17, 2011; U.S. Appl. No. 12/768,332 (56 p.).
Office Action dated Oct. 17, 2011; U.S. Appl. No. 12/768,324 (18 p.).
Canadian Office Action dated Oct. 14, 2011; Canadian Application No. 2,526,714 (3 p.).
Notice of Allowance dated Oct. 24, 2011; U.S. Appl. No. 12/515,534 (7 p.).
Corrected Notice of Allowance dated Oct. 26, 2011; U.S. Appl. No. 12/541,938 (8 p.).
European Exam Report dated Nov. 14, 2011; European Application No. 05781685.2 (3 p.).
European Decision to Grant dated Nov. 4, 2011; European Application No. 01980737.9 (4 p.).
Supplemental Notice of Allowability dated Dec. 6, 2011; U.S. Appl. No. 12/768,332 (10 p.).
Notice of Allowance dated Dec. 16, 2011; U.S. Appl. No. 13/116,889 (7 p.).
Response to Office Action dated Aug. 22, 2011; Response dated Dec. 22, 2011; European Application No. 10185612.8 (2 p.).
Office Action dated Dec. 22, 2011; U.S. Appl. No. 12/515,729 (31 p.).
Notice of Allowance dated Dec. 23, 2011; U.S. Appl. No. 12/768,337 (5 p.).
Examination Report dated Dec. 20, 2011; GB Application No. 0821072.6 (2 p.).
Observations dated May 10, 2011; GB Application No. 0821072.6 (19 p.).
European Response to Exam Report; European Application No. 10167184.0; Response filed Jan. 4, 2012 (142 p.).
Supplemental Notice of Allowability dated Jan. 9, 2012; U.S. Appl. No. 13/116,889 (10 p.).
European Response to Office Action; European Application No. 10185795.1; Response filed Jan. 23, 2012 (2 p.).
European Response to Office Action; European Application No. 10013192.9; Response filed Jan. 23, 2012 (2 p.).
Supplemental Notice of Allowance; U.S. Appl. No. 12/768,337 (10 p.).
Notice of Allowance dated Feb. 22, 2012; NO Application No. 20015431 (2 p.).
Response to Office Action dated Oct. 17, 2011 U.S. Appl. No. 12/768,324 (5 p.).
Canadian Notice of Allowance dated Feb. 23, 2012; Canadian Application No. 2,555,403 (1 p.).
U.S. Response to Office Action Dated Dec. 22, 2011; Response filed Mar. 22, 2012; U.S. Appl. No. 12/515,729 (14p.).
U.S. Corrected Notice of Allowability dated Mar. 29, 2012; U.S. Appl. No. 13/116,889 (11p.).
Canadian Response to Office Action dated Oct. 7, 2011; Response filed Mar. 22, 2012; Canadian Application No. 2,526,714 (18 p.).
European Office Action Pursuant to Article 94(3) dated Dec. 29, 2010; Application No. 06024001.7 (4 p.).
Norwegian Examination Report dated Aug. 19, 2005; Application No. 20015431 (6 p.).
Response to Norwegian Examination Report dated Aug. 19, 2005; Application No. 20015431 (19 p.).
Norwegian Examination Report dated Mar. 22, 2010; Application No. 20032037 (8 p.).
Norwegian Office Action dated Oct. 20, 2010; Application No. 20032037 (4 p.).
International Search Report dated Mar. 4, 2002; PCT/GB01/04940 (3 p.).

(56) References Cited

OTHER PUBLICATIONS

International Search Report and Written Opinion dated Sep. 22, 2004; PCT/GB2004/002329 (13 p.).
International Search Report and Written Opinion dated Jun. 7, 2005; PCT/GB2005/000725 (8 p.).
International Search Report and Written Opinion dated Jan. 27, 2006; PCT/GB2005/003422 (8 p.).
International Search Report and Written Opinion dated Apr. 16, 2007; PCT/GB2004/002329 (10 p.).
International Search Report and Written Opinion dated Jun. 13, 2008; PCT/US2007/084884 (8 p.).
International Search Report and Written Opinion dated Jun. 13, 2008; PCT/US2007/084879 (9 p.).
International Search Report and Written Opinion dated Aug. 12, 2008; PCT/US2007/078346 (9 p.).
www.subsea7.com; "Multiple Application Re-Injection System" (undated) (2 p.).
Baker Hughes; "Intelligent Well System;Complete Range of Intelligent Well Systems," (undated) (4 p.).
Notice of Litigation for U.S. Appl. No. 10/558,593 (77 p.).
Patent Search Report INPADOC Patent Family (3 p.) (undated).
Venture Training Manual Part 1 (undated) (48 p.).
Venture Training Manual Part 2 (undated) (25 p.).
ABB Retrievable Choke Insert pp. 3, 8 (undated) (2 p.).
Kvaerner Pump Photo "G" (undated) (1 p.).
Aker Kvaerner; Multibooster System "H" (undated) (4 p.).
Progressing Cavity and Piston Pumps; National Oilwell "K" (undated) (2 p.).
Weatherford Artificial Lift Systems "M" (2 p.).
"Under Water Pump for Sea Bed Well" by A. Nordgren, "I" Dec. 14, 1987 (2 p.).
Petroleum Abstracts Oct. 25, 2001 (48 p.).
Petroleum Abstracts Oct. 30, 2001 (79 p.).
Derwent Abstracts Nov. 2, 2001 (16 p.).
www.subsea7.com "New Technology to Increase Oil Production Introduce to Subsea Market," Jun. 13, 2002 (2 p.).
ABB Brochure entitled "Subsea Chokes and Actuators" dated Oct. 2002 (12 p.).
Kvaerner Oilfield Products A.S. Memo-Multiphase Pumping Technical Issues, dated May 19, 2004 "D" (10 p.).
Offshore Article "Multiphase Pump," Jul. 2004 "C" (1 p.).
Jetech DA-4D & DA-8D Ultra-High Pressure Increases "L" (3 p.).
Force Pump, Double-Acting, Internet, Glossary "J" dated Sep. 7, 2004 (2 p.).
Online Publication: Weatherford Ram Pump dated Aug. 10, 2005 "B" (2 p.).
Framo Multiphase Booster Pumps dated Aug. 10, 2005 "F" (1 p.).
A750/09, In the Court of Session, Intellectual Property Action, Closed Record, In the Cause *DES Operations et al.* vs. *Vetco Gray, Inc., et al.*, Updated record to include adjusted Answers to Minute of Amendment Oct. 21, 2010 (90p.).
A750/09, In the Court of Session, Intellectual Property Action, Note of Arguments for the First to Fifth Defenders Dec. 30, 2010 (18 p.).
A750/09, In the Court of Session, Intellectual Property Cause; Response to the Pursuers to the Note of Argument for the Defenders Mar. 3, 2011 (12 p.).
A750/09, In the Court of Session, Intellectual Property Action, Open Record, D.E.S. Operations Limited, Cameron Systems Ireland Limited (Pursuers) against Vetco Gray, Inc., Paul White, Paul Milne, and Norma Brammer (Defenders) Adjusted for the Pursuers Feb. 9, 2010 as further adjusted for the Pursuers Apr. 6, 2010 (53pp).
Initiation of Proceedings Before the Comptroller, Oct. 22, 2009; In the Matter of DES Operations Limited and Cameron Systems Ireland Limited and Vetco Gray Inc., and In the Matter of an Application Under Sections 133, 91A, 121A, and 371 of the Patent Act 1977, Statement of Grounds, Oct. 22, 2009 (21pp).
Singapore Examination Report dated Jan. 10, 2007; Application No. 200507390-3 (5 p.).
Singapore Written Opinion dated May 3, 2010; Application No. 200903220-2 (5 p.).
Singapore Written Opinion dated Oct. 12, 2010; Application No. 200903221-0 (11 p.).
Response to Singapore Written Opinion Dated Oct. 12, 2010; Application No. 200903221-0; Response filed Mar. 8, 2011 (11 p.).
U.S. Office Action dated Feb. 26, 2003; U.S. Appl. No. 10/009,991 (5 p.).
Response to Office Action dated Feb. 26, 2003; U.S. Appl. No. 10/009,991; Response filed May 12, 2003 (7 p.).
Notice of Allowance dated May 28, 2003; U.S. Appl. No. 10/009,991 (5 p.).
Provisional Application filed Oct. 22, 2003; U.S. Appl. No. 60/513,294 (15 p.).
Provisional Application filed Feb. 26, 2004; U.S. Appl. No. 60/548,630 (23 p.).
European Response to Office Action Filed Mar. 13, 2014; European Application No. 10161116.8 (17 p.).
European Response to Office Action Filed Mar. 13, 2014; European Application No. 101671824 (10 p.).
European Response to Office Action Filed Mar. 13, 2014; European Application No. 10013192.9 (13 p.).
U.S. Notice of Allowance Dated Jan. 31, 2014; U.S. Appl. No. 13/415,635 (38 p.).

* cited by examiner

FIG. 1
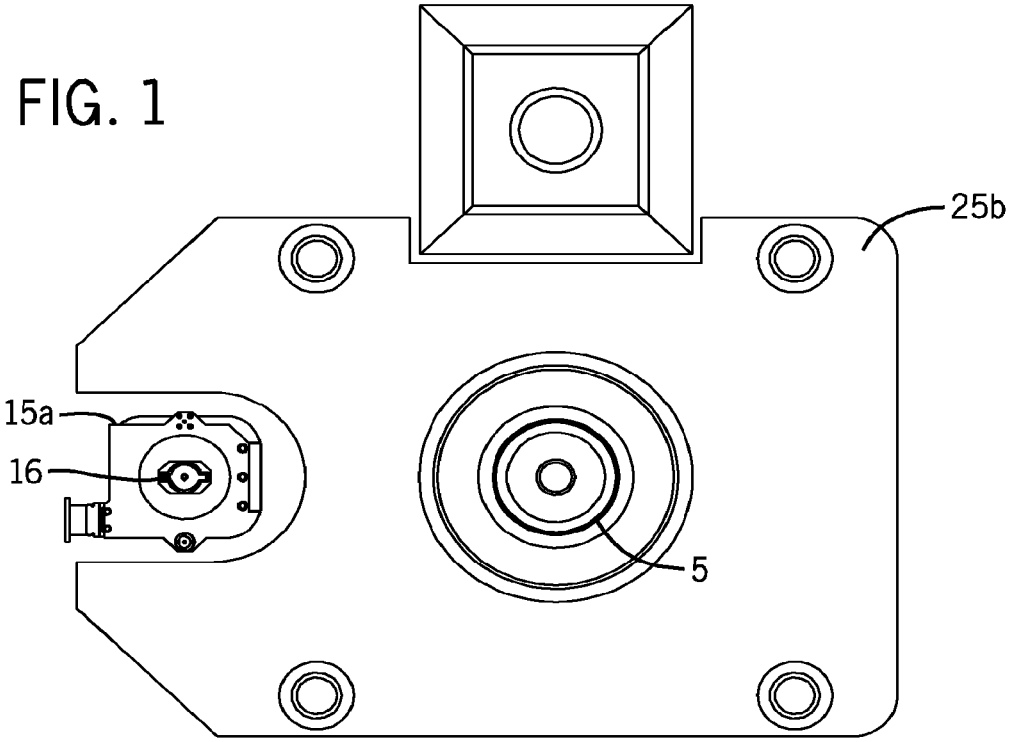
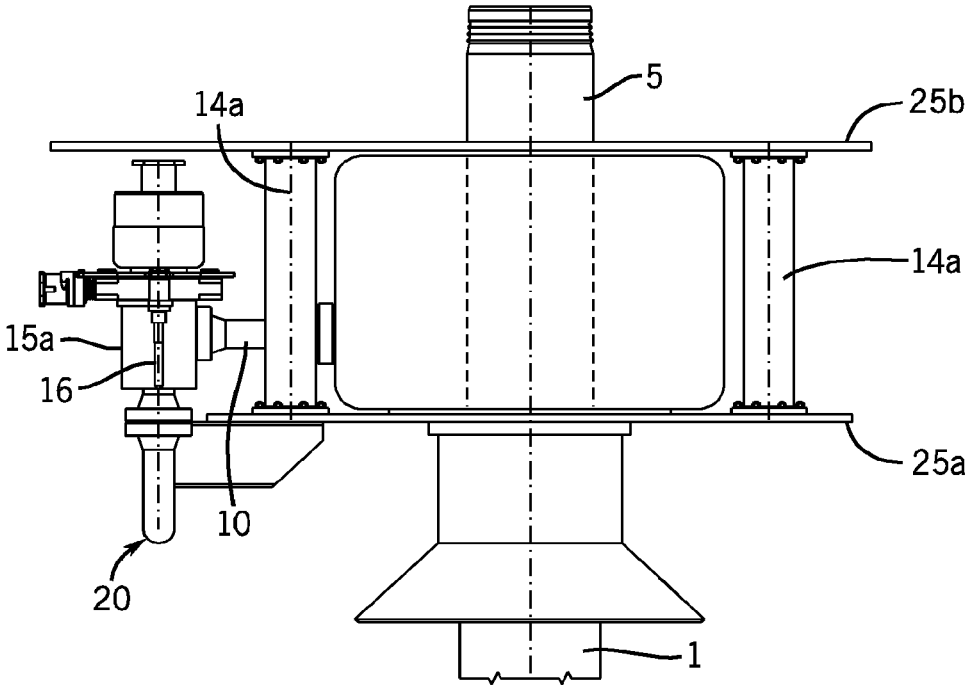
FIG. 2

APPARATUS AND METHOD FOR PROCESSING FLUIDS FROM A WELL

CROSS REFERENCE TO RELATED APPLICATIONS

This application is a divisional of U.S. application Ser. No. 12/515,729 filed May 20, 2009, which is a 35 U.S.C. §371 national stage application of PCT/US2007/84884 filed Nov. 15, 2007, which claims the benefit of British Patent Application No. 0625526.9 filed Dec. 18, 2006, each of which is hereby incorporated herein by reference in its entirety for all purposes.

FIELD OF THE INVENTION

The present invention relates to apparatus and methods for processing well fluids. Embodiments of the invention can be used for recovery and injection of well fluids. Some embodiments relate especially but not exclusively to recovery and injection, into either the same, or a different well.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are employed to access and extract the resource. These systems can be located onshore or offshore depending on the location of a desired resource. Further, such systems generally include a wellhead assembly through which the resource is extracted. These wellhead assemblies generally include a wide variety of components and/or conduits, such as a christmas tree (tree), various control lines, casings, valves, and the like, that control drilling and/or extraction operations.

Subsea manifolds such as trees (sometimes called christmas trees) are well known in the art of oil and gas wells, and generally comprise an assembly of pipes, valves and fittings installed in a wellhead after completion of drilling and installation of the production tubing to control the flow of oil and gas from the well. Subsea trees typically have at least two bores one of which communicates with the production tubing (the production bore), and the other of which communicates with the annulus (the annulus bore).

Typical designs of conventional trees may have a side outlet (a production wing branch) to the production bore closed by a production wing valve for removal of production fluids from the production bore. The annulus bore also typically has an annulus wing branch with a respective annulus wing valve. The top of the production bore and the top of the annulus bore are usually capped by a tree cap which typically seals off the various bores in the tree, and provides hydraulic channels for operation of the various valves in the tree by means of intervention equipment, or remotely from an offshore installation.

Wells and trees are often active for a long time, and wells from a decade ago may still be in use today. However, technology has progressed a great deal during this time, for example, subsea processing of fluids is now desirable. Such processing can involve adding chemicals, separating water and sand from the hydrocarbons, etc.

Conventional treatment methods involve conveying the fluids over long distances for remote treatment, and some methods and apparatus include localized treatment of well fluids, by using pumps to boost the flow rates of the well fluids, chemical dosing apparatus, flow meters and other types of treatment apparatus.

One problem with locating the treatment apparatus locally on the tree is that the treatment apparatus can be bulky and can obstruct the bore of the well. Therefore, intervention operations requiring access to the wellbore can require removal of the treatment apparatus before access to the well can be gained.

SUMMARY OF THE INVENTION

According to a first aspect of the present invention there is provided an apparatus for the processing of fluids from an oil or gas well, the apparatus comprising a processing device, and a wellbore extension conduit.

Typically the apparatus is modular and the wellbore extension conduit extends through the module. The wellbore extension conduit typically comprises sealed tubing that optionally extends at least partially through a central axis of the apparatus, and the processing device is arranged around the central axis, spaced from the wellbore extension conduit.

The apparatus can be built in modules, with a first part of the module, for example, a lower surface, being adapted to attach to an interface of a manifold such as a tree, and a second part, for example an upper surface, being adapted to attach to a further module. The second part (e.g. the upper surface) can typically be arranged in the same manner as the manifold interface, so that further modules can be attached to the first module, which typically has the same connections and footprint of the manifold interface. Thus, modules adapted to connect to the manifold interface in the same manner as the first module can connect instead to the first or to subsequent modules in the same manner, allowing stacking of separate modules on the manifold, each one connecting to the module below as if it were connecting to the manifold interface.

The wellbore extension conduit is typically straight and is aligned with the wellbore, although some embodiments of the invention incorporate versions in which the wellbore extension conduit is deviated from the axis of the wellbore itself. Embodiments with straight extension conduits in axial alignment with the wellbore have the advantage that the wellbore can be accessed in a straight line, and plugs or other items in the wellbore, perhaps below the tree, can be pulled through the modules via the extension conduits without removing or adjusting the modules. Embodiments in which the wellbore extension conduit is deviated from the axis of the wellbore tend to be more compact and adaptable to large pieces of processing equipment. The wellbore can be the production bore, or a production flowline.

The upper surface of the module will typically have fluid and/or power conduit connectors in the same locations as the respective connectors are disposed in the lower surface, but typically, the upper surface connectors will be adapted to mate with the lower surface connectors, so that the upper surface connectors can mate with the lower surface connectors on the lower surface of the module above. Therefore, where the upper surface has a male connector, the lower surface can typically have a female connector, or vice versa.

Typically the module can have support structures such as posts that are adapted to transfer loads across the module to the hard points on the manifold. In certain embodiments, the weight of the processing modules can be borne by the wellbore mandrel.

In some embodiments, the processing device can connect directly into the wellbore mandrel. For example, conduits connecting directly to the mandrel can route fluids to be processed to the processing device. The processing device can optionally connect to a branch of the manifold, typically to a wing branch on a tree. The processing device can typically have an inlet that draws production fluids from a diverter insert located in a choke conduit of the branch of the manifold, and can return the fluids to the diverter insert via an outlet, after processing.

The diverter insert can have a flow diverter to divide the choke conduit into two separate fluid flowpaths within the choke conduit, for example the choke body, and the flow diverter can be arranged to control the flow of fluids through the choke body so that the fluids from the well to be processed are diverted through one flowpath and are recovered through another, for transfer to a flowline, or optionally back into the well. Optionally the flow diverter has a separator to divide the branch bore into two separate regions.

The oil or gas well is typically a subsea well but the invention is equally applicable to topside wells. The manifold may be a gathering manifold at the junction of several flow lines carrying production fluids from, or conveying injection fluids to, a number of different wells. Alternatively, the manifold may be dedicated to a single well; for example, the manifold may comprise a christmas tree.

By "branch" we mean any branch of the manifold, other than a production bore of a tree. The wing branch is typically a lateral branch of the tree, and can be a production or an annulus wing branch connected to a production bore or an annulus bore respectively.

Optionally, the flow diverter is attached to a choke body. "Choke body" can mean the housing which remains after the manifold's standard choke has been removed. The choke may be a choke of a tree, or a choke of any other kind of manifold.

The flow diverter could be located in a branch of the manifold (or a branch extension) in series with a choke. For example, in an embodiment where the manifold comprises a tree, the flow diverter could be located between the choke and the production wing valve or between the choke and the branch outlet. Further alternative embodiments could have the flow diverter located in pipework coupled to the manifold, instead of within the manifold itself. Such embodiments allow the flow diverter to be used in addition to a choke, instead of replacing the choke.

Embodiments where the flow diverter is adapted to connect to a branch of a tree means that the tree cap does not have to be removed to fit the flow diverter. Embodiments of the invention can be easily retro-fitted to existing trees. Preferably, the flow diverter is locatable within a bore in the branch of the manifold. Optionally, an internal passage of the flow diverter is in communication with the interior of the choke body, or other part of the manifold branch.

The invention provides the advantage that fluids can be diverted from their usual path between the well bore and the outlet of the wing branch. The fluids may be produced fluids being recovered and traveling from the well bore to the outlet of a tree. Alternatively, the fluids may be injection fluids traveling in the reverse direction into the well bore. As the choke is standard equipment, there are well-known and safe techniques of removing and replacing the choke as it wears out. The same tried and tested techniques can be used to remove the choke from the choke body and to clamp the flow diverter onto the choke body, without the risk of leaking well fluids into the ocean. This enables new pipework to be connected to the choke body and hence enables safe re-routing of the produced fluids, without having to undertake the considerable risk of disconnecting and reconnecting any of the existing pipes (e.g. the outlet header).

Some embodiments allow fluid communication between the well bore and the flow diverter. Other embodiments allow the wellbore to be separated from a region of the flow diverter. The choke body may be a production choke body or an annulus choke body. Preferably, a first end of the flow diverter is provided with a clamp for attachment to a choke body or other part of the manifold branch. Optionally, the flow diverter has a housing that is cylindrical and typically the internal passage extends axially through the housing between opposite ends of the housing. Alternatively, one end of the internal passage is in a side of the housing.

Typically, the flow diverter includes separation means to provide two separate regions within the flow diverter. Typically, each of these regions has a respective inlet and outlet so that fluid can flow through both of these regions independently. Optionally, the housing includes an axial insert portion.

Typically, the axial insert portion is in the form of a conduit. Typically, the end of the conduit extends beyond the end of the housing. Preferably, the conduit divides the internal passage into a first region comprising the bore of the conduit and a second region comprising the annulus between the housing and the conduit. Optionally, the conduit is adapted to seal within the inside of the branch (e.g. inside the choke body) to prevent fluid communication between the annulus and the bore of the conduit.

Alternatively, the axial insert portion is in the form of a stem. Optionally, the axial insert portion is provided with a plug adapted to block an outlet of the christmas tree, or other kind of manifold. Preferably, the plug is adapted to fit within and seal inside a passage leading to an outlet of a branch of the manifold. Optionally, the diverter assembly provides means for diverting fluids from a first portion of a first flowpath to a second flowpath, and means for diverting the fluids from a second flowpath to a second portion of a first flowpath. Preferably, at least a part of the first flowpath comprises a branch of the manifold. The first and second portions of the first flowpath could comprise the bore and the annulus of a conduit.

The diverter insert is optional and in certain embodiments the processing device can take fluids from a bore of the well and return them to the same or a different bore, or to a branch, without involving a flow diverter having more than one flowpath. For example, the fluids could be taken through a plain single bore conduit from one hub on a tree into the processing apparatus, and back into a second hub on the same or a different tree, through a plain single bore conduit.

According to a second aspect of the present invention there is provided a manifold having apparatus according to the first aspect of the invention. Typically, the processing device is chosen from at least one of: a pump; a process fluid turbine; injection apparatus for injecting gas or steam; chemical injection apparatus; a chemical reaction vessel; pressure regulation apparatus; a fluid riser; measurement apparatus; temperature measurement apparatus; flow rate measurement apparatus; constitution measurement apparatus; consistency measurement apparatus; gas separation apparatus; water separation apparatus; solids separation apparatus; and hydrocarbon separation apparatus.

Optionally, the flow diverter provides a barrier to separate a branch outlet from a branch inlet. The barrier may separate a branch outlet from a production bore of a tree. Optionally, the barrier comprises a plug, which is typically located inside the choke body (or other part of the manifold branch) to block the branch outlet. Optionally, the plug is attached to the housing by a stem which extends axially through the internal passage of the housing.

Alternatively, the barrier comprises a conduit of the diverter assembly which is engaged within the choke body or other part of the branch. Optionally, the manifold is provided with a conduit connecting the first and second regions. Optionally, a first set of fluids are recovered from a first well via a first diverter assembly and combined with other fluids in a communal conduit, and the combined fluids are then diverted into an export line via a second diverter assembly connected to a second well.

According to a fourth aspect of the present invention, there is provided a method of processing wellbore fluids, the method comprising the steps of: connecting a processing apparatus to a manifold, wherein the processing apparatus has a processing device and a wellbore extension conduit, and wherein the wellbore extension conduit is connected to the wellbore of the manifold; diverting the fluids from a first part of the wellbore of the manifold to the processing device; processing the fluids in the processing device; and returning the processed fluids to a second part of the wellbore of the manifold.

Typically, the method is for recovering fluids from a well, and includes the final step of diverting fluids to an outlet of the first flowpath for recovery therefrom. Alternatively or additionally, the method is for injecting fluids into a well. The fluids may be passed in either direction through the diverter assembly.

BRIEF DESCRIPTION OF THE DRAWINGS

Various features, aspects, and advantages of the present invention will become better understood when the following detailed description is read with reference to the accompanying figures in which like characters represent like parts throughout the figures, wherein:

FIG. 1 is a plan view of a typical horizontal production tree;

FIG. 2 is a side view of the FIG. 1 tree;

DETAILED DESCRIPTION OF SPECIFIC EMBODIMENTS

Figure 3:
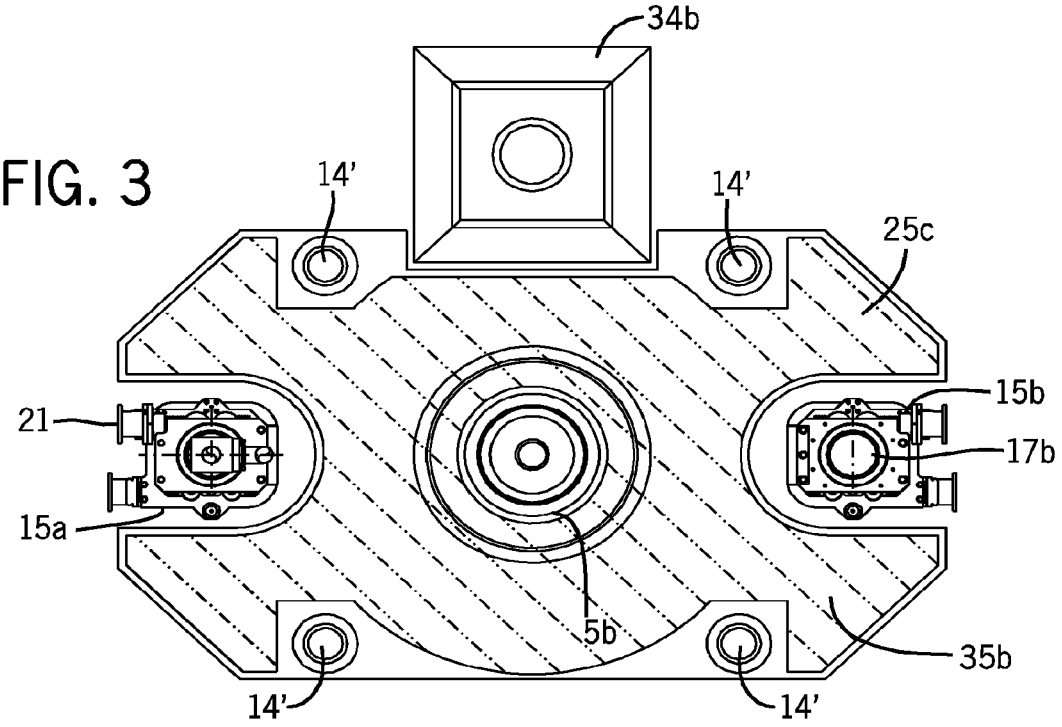
FIG. 3 is a plan view of FIG. 1 tree with a first fluid processing module in place.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Referring now to the drawings, a typical production manifold on an offshore oil or gas wellhead comprises a christmas tree with a production bore 1 leading from production tubing (not shown) and carrying production fluids from a perforated region of the production casing in a reservoir (not shown). An annulus bore 2 (see FIG. 9) leads to the annulus between the casing and the production tubing. A tree cap typically seals off the production bore 1, and provides a number of hydraulic control channels by which a remote platform or intervention vessel can communicate with and operate valves in the christmas tree. The cap is removable from the christmas tree in order to expose the production bore in the event that intervention is required and tools need to be inserted into the wellbore. In the modern horizontal trees shown in FIGS. 1-5, a large diameter production bore 1 is provided to feed production fluids directly to a production wing branch 10 from which they are recovered.

Figure 9:
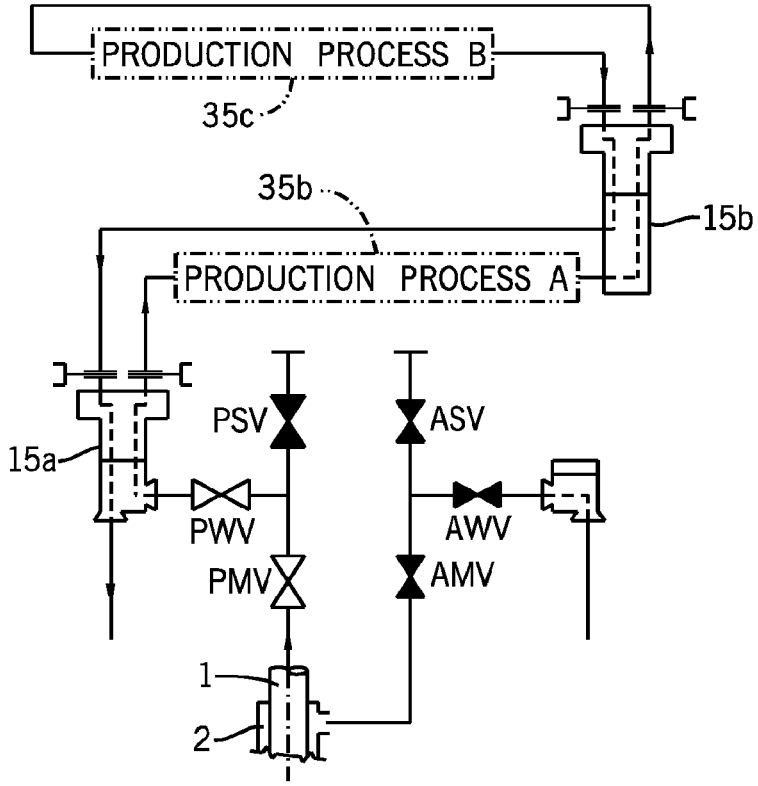
FIG. 9 is a schematic diagram showing the flowpaths of the FIG. 5 arrangement.
Figure 10:
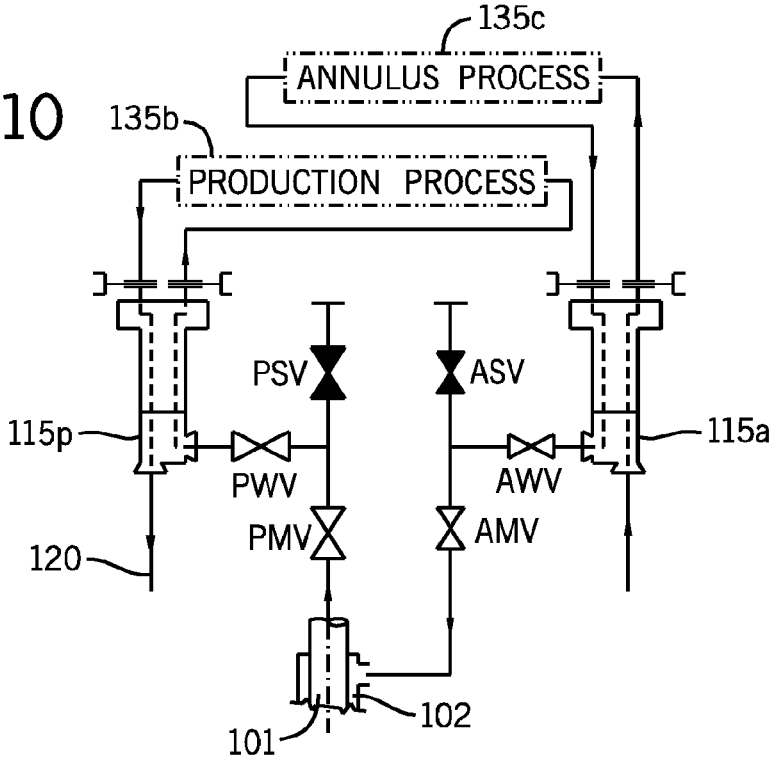
FIG. 10 is a schematic diagram showing the flowpaths of the FIG. 8 arrangement.

The flow of fluids through the production and annulus bores is governed by various valves shown in the schematic arrangements of FIGS. 9 and 10. The production bore 1 has a branch 10 which is closed by a production wing valve PWV. A production swab valve PSV closes the production bore 1 above the branch 10, and a production master valve PMV closes the production bore 1 below the branch 10.

The annulus bore 2 is closed by an annulus master valve AMV below an annulus outlet controlled by an annulus wing valve AWV. An annulus swab valve ASV closes the upper end of the annulus bore 2.

All valves in the tree are typically hydraulically controlled by means of hydraulic control channels passing through the cap and the body of the apparatus or via hoses as required, in response to signals generated from the surface or from an intervention vessel.

When production fluids are to be recovered from the production bore 1, PMV is opened, PSV is closed, and PWV is opened to open the branch 10 which leads to a production flowline or pipeline 20. PSV and ASV are generally only opened if intervention is required.

The wing branch 10 has a choke body 15*a* in which a production choke 16 is disposed, to control the flow of fluids through the choke body and out through production flowline 20.

The manifold on the production bore 1 typically comprises a first plate 25*a* and a second plate 25*b* spaced apart in vertical relationship to one another by support posts 14*a*, so that the second plate 25*b* is supported by the posts 14*a* directly above the first plate 25*a*. The space between the first plate 25*a* and the second plate 25*b* is occupied by the fluid conduits of the wing branch 10, and by the choke body 15*a*. The choke body 15*a* is usually mounted on the first plate 25*a*, and above it, the second plate 25*b* will usually have a cut-out section to facilitate access to the choke 16 in use.

The first plate 25*a* and the second plate 25*b* each have central apertures that are axially aligned with one another and with the production bore 1 for allowing passage of the central mandrel 5 of the wellbore, which protrudes between the plates 25 and extends through the upper surface of the second plate to permit access to the wellbore from above the wellhead for intervention purposes. The upper end of the central mandrel is optionally capped with the tree cap or a debris cover (removed in drawings) to seal off the wellbore in normal operation.

Figure 4:
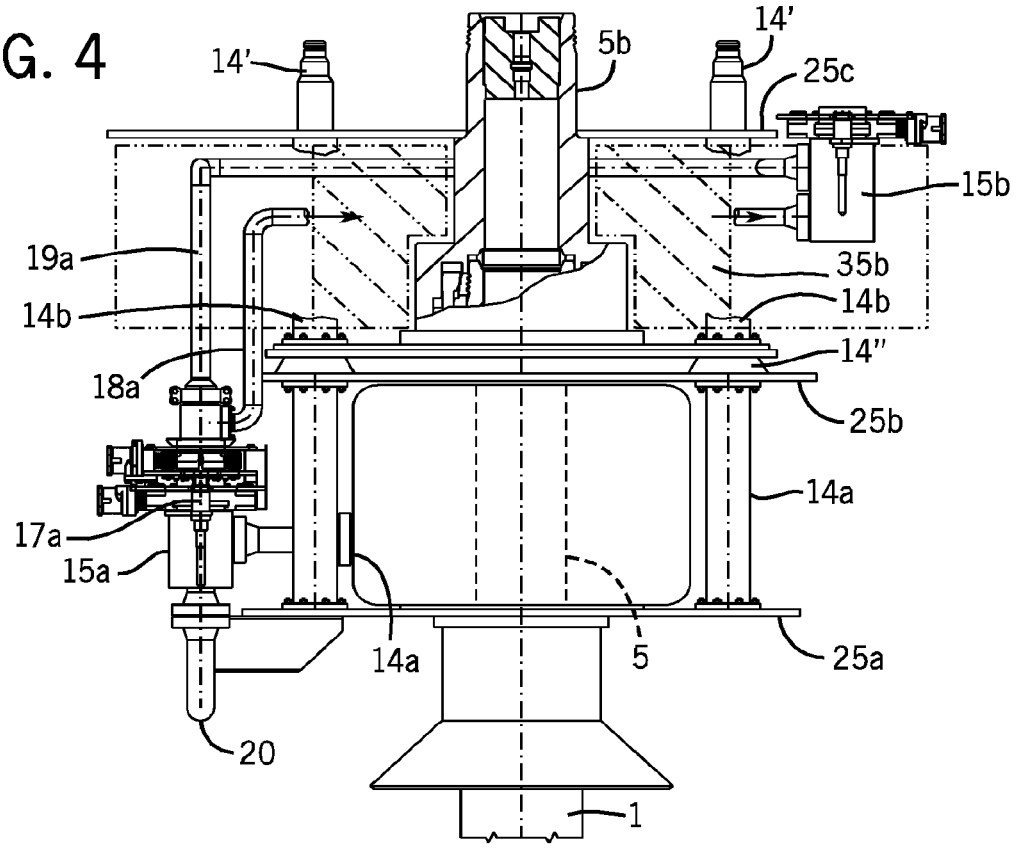
FIG. 4 is a side view of the FIG. 3 arrangement.

Referring now to FIGS. 3 and 4, the conventional choke 16 has been removed from the choke body 15*a*, and has been replaced by a fluid diverter that takes fluids from the wing branch 10 and diverts them through an annulus of the choke body to a conduit 18*a* that feeds them to a first processing module 35*b*. The second plate 25*b* can optionally act as a platform for mounting the first processing module 35*b*. A second set of posts 14*b* are mounted on the second plate 25*b* directly above the first set of posts 14*a*, and the second posts 14*b* support a third plate 25*c* above the second plate 25*b* in the same manner as the first posts 14*a* support the second plate 25*b* above the first plate 25*a*. Optionally, the first processing module 35*b* disposed on the second plate 25*b* has a base that rests on feet set directly in line with the posts 14 in order to transfer loads efficiently to the hard points of the tree. Optionally, loads can be routed through the mandrel of the wellbore, and the posts and feet can be omitted.

The first processing module contains a processing device for processing the production fluids from the wing branch 10. Many different types of processing devices could be used here. For example, the processing device could comprise a pump or process fluid turbine, for boosting the pressure of the production fluids. Alternatively, or additionally, the processing apparatus could inject gas, steam, sea water, or other material into the fluids. The fluids pass from the conduit 18*a* into the first processing module 35*b* and after treatment or processing, they are passed through a second choke body 15*b* which is blanked off with a cap, and which returns the processed production fluids to the first choke body 15*a* via a return conduit 19*a*. The processed production fluids pass through the central axial conduit of the fluid diverter in the choke body 15*a*, and leave it via the production flowpath 20. After the processed fluids have left the choke body 15*a*, they can be recovered through a normal pipeline back to the surface, or re-injected into a well, or can be handled or further processed in any other way desirable.

The injection of gas could be advantageous, as it would give the fluids "lift". The addition of steam has the effect of adding energy to the fluids.

Injecting sea water into a well could be useful to boost the formation pressure for recovery of hydrocarbons from the well, and to maintain the pressure in the underground formation against collapse. Also, injecting waste gases or drill cuttings etc into a well obviates the need to dispose of these at the surface, which can prove expensive and environmentally damaging.

The processing device could also enable chemicals to be added to the fluids, e.g. viscosity moderators, which thin out the fluids, making them easier to pump, or pipe skin friction moderators, which minimize the friction between the fluids and the pipes. Further examples of chemicals which could be injected are surfactants, refrigerants, and well fracturing chemicals. Processing device could also comprise injection water electrolysis equipment. The chemicals/injected materials could be added via one or more additional input conduits.

The processing device could also comprise a fluid riser, which could provide an alternative route between the well bore and the surface. This could be very useful if, for example, the branch 10 becomes blocked.

Alternatively, processing device could comprise separation equipment e.g. for separating gas, water, sand/debris and/or hydrocarbons. The separated component(s) could be siphoned off via one or more additional processes.

The processing device could alternatively or additionally include measurement apparatus, e.g. for measuring the temperature/flow rate/constitution/consistency, etc. The temperature could then be compared to temperature readings taken from the bottom of the well to calculate the temperature change in produced fluids. Furthermore, the processing device could include injection water electrolysis equipment.

Alternative embodiments of the invention can be used for both recovery of production fluids and injection of fluids, and the type of processing apparatus can be selected as appropriate.

A suitable fluid diverter for use in the choke body 15*a* in the FIG. 4 embodiment is described in application WO/2005/047646, the disclosure of which is incorporated herein by reference.

The processing device(s) is built into the shaded areas of the processing module 35*b* as shown in the plan view of FIG. 3, and a central axial area is clear from processing devices, and houses a first mandrel extension conduit 5*b*. At its lower end near to the second plate 25*b*, the first mandrel extension conduit 5*b* has a socket to receive the male end of the wellbore mandrel 5 that extends through the upper surface of the second plate 25*b* as shown in FIG. 2. The socket has connection devices to seal the extension conduit 5*b* to the mandrel 5, and the socket is stepped at the inner surface of the mandrel extension conduit 5*b*, so that the inner bore of the mandrel 5 is continuous with the inner bore of the mandrel extension conduit 5*b* and is sealed thereto. When the mandrel extension conduit 5*b* is connected to the mandrel 5, it effectively extends the bore of the mandrel 5 upwards through the upper surface of the third plate 25*c* to the same extent as the mandrel 5 extends through the second plate 25*b* as shown in FIG. 2.

The upper surface of the third plate 25*c* though which the first mandrel extension conduit 5*b* protrudes, as shown in FIG. 4, has, therefore, the same profile (as regards the wellbore mandrel) as the basic tree shown in FIG. 1. The mandrel extension conduit 5*b* can be plugged. The other features of the upper surface of the third plate 35*c* are also arranged as they are on the basic tree, for example, the hard points for weight bearing are provided by the posts 14, and other fluid connections that may be required (for example hydraulic signal conduits at the upper face of the second plate 25*b* that are needed to operate instruments on the tree) can have continuous conduits that provide an interface between the third plate 25*c* and the second 25*b*.

The third plate 25*c* has a cut out section to allow access to the second choke body 15*b*, but this can be spaced apart from the first choke body 15*a*, and does not need to be directly above. This illustrates that while it is advantageous in certain circumstances for the conduit adapting to the basic tree to be in the same place on the upper surface as its corresponding feature is located on the lower plate, it is not absolutely necessary, and linking conduits (such as conduits 18 and 19) can be routed around the processing devices as desired.

The guide posts 14 can optionally be arranged as stab posts 14' extending upward from the upper surface of the plates, and mating with downwardly-facing sockets 14" on the base of the processing module above them, as shown in FIG. 4. In either event, it is advantageous (but not essential) that the support posts on a lower module are directly beneath those on an upper module, to enhance the weight bearing characteristics of the apparatus. A control panel 34*b* can be provided for the control of the processing module 35*b*. In the example shown in FIG. 4, the processing module comprises a pump.

Figure 5:
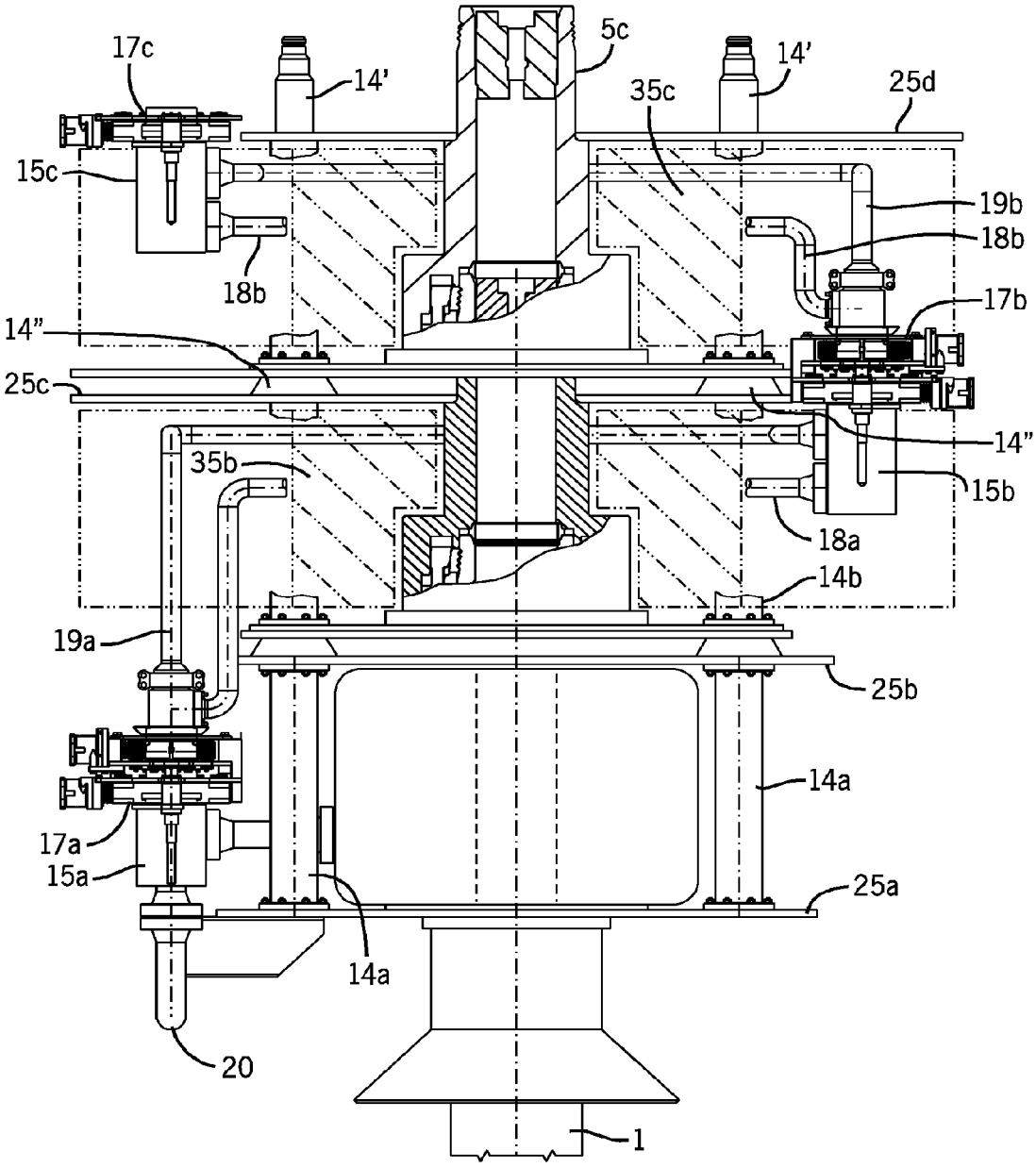
FIG. 5 is a side view of the FIG. 3 arrangement with a further fluid processing module in place.

Referring now to FIG. 5, a second processing module 35*c* has been installed on the upper surface of the third plate 25*c*. The blank cap in the second choke body 15*b* has been replaced with a fluid diverter 17*b* similar to the diverter now occupying the first choke body 15*a*. The diverter 17*b* is provided with fluid conduits 18*b* and 19*b* to send fluids to the second processing module 35*c* and to return them therefrom, via a further blanked choke body 15*c*, for transfer back to the first choke body 15*a*, and further treatment, recovery or injection as previously described.

Above the second processing module 35*c* is a fourth plate 25*d*, which has the same footprint as the second and third plates, with guide posts 14" and fluid connectors etc in the same locations. The second processing module 35*c*, which may incorporate a different processing device from the first module 35*b*, for example a chemical dosing device, is also built around a second central mandrel extension conduit 5*c*, which is axially aligned with the mandrel bore 5 and the first extension 5*b*. It has sockets and seals in order to connect to the first mandrel extension conduit just as the first extension conduit 5*b* connects to the mandrel 5, so the mandrel effectively extends continuously through the two processing units 35*b* and 35*c* and has the same top profile as the basic wellhead, thereby facilitating intervention using conventional equipment without having to remove the processing units.

Figure 6:
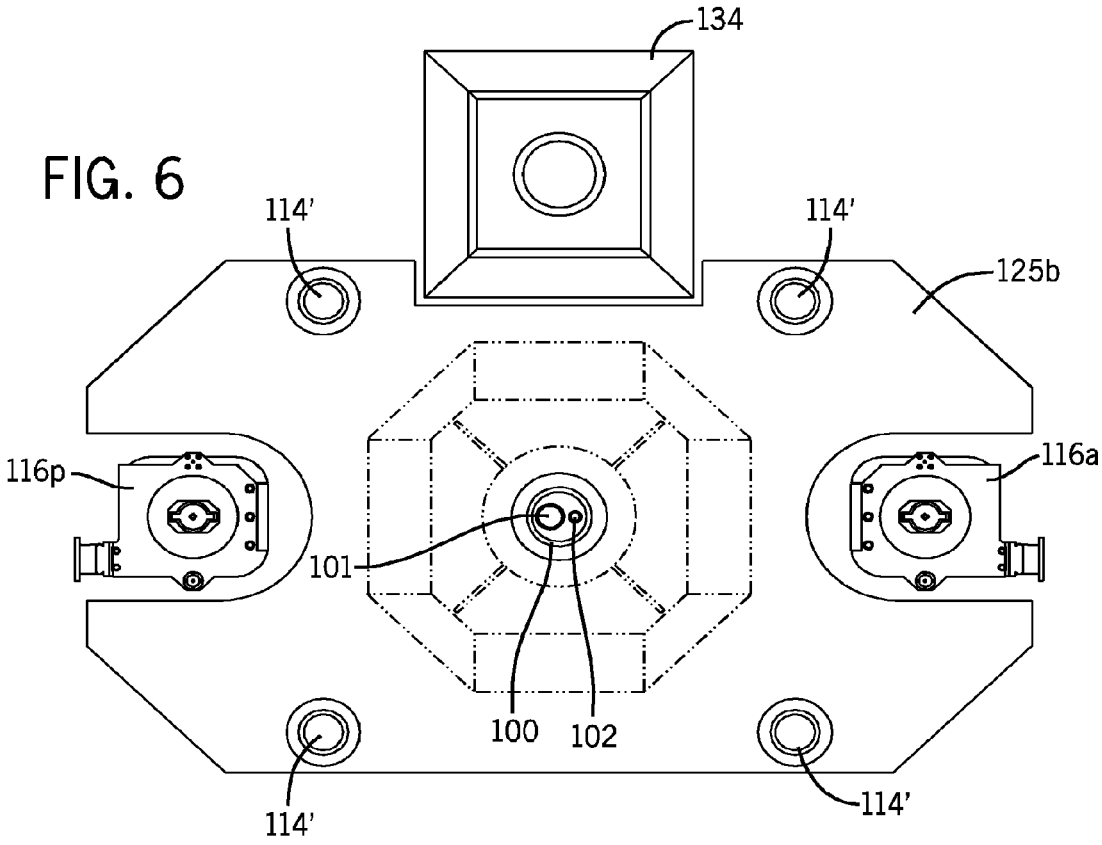
FIG. 6 is a plan view of a typical vertical production tree.
Figure 7:
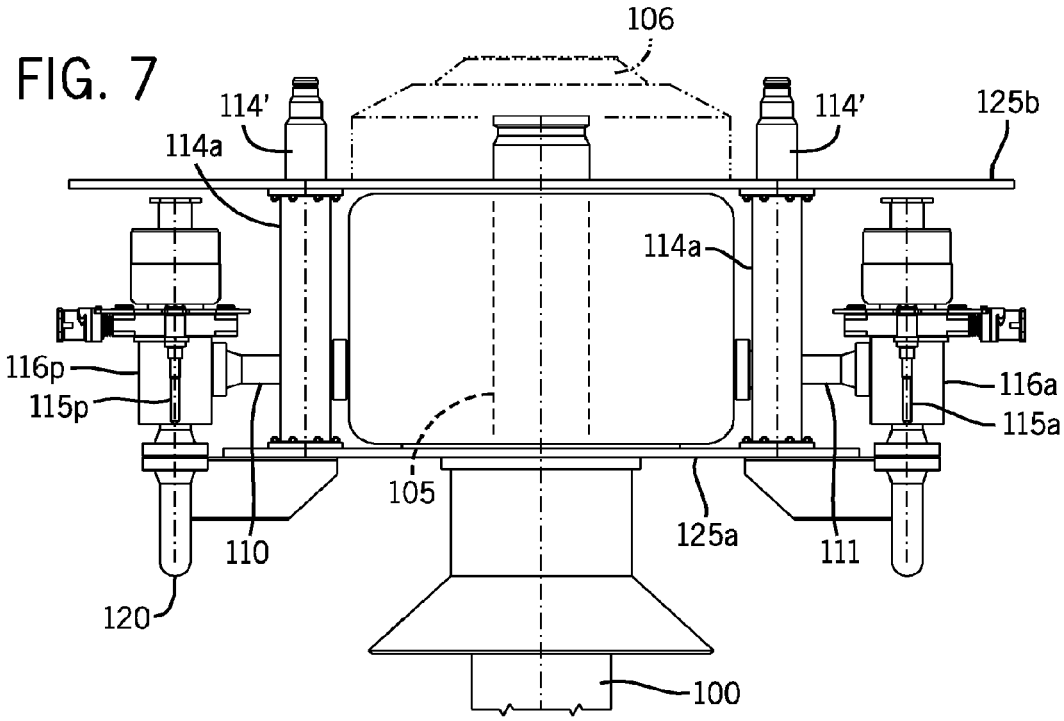
FIG. 7 is a side view of the FIG. 6 tree.
Figure 8:
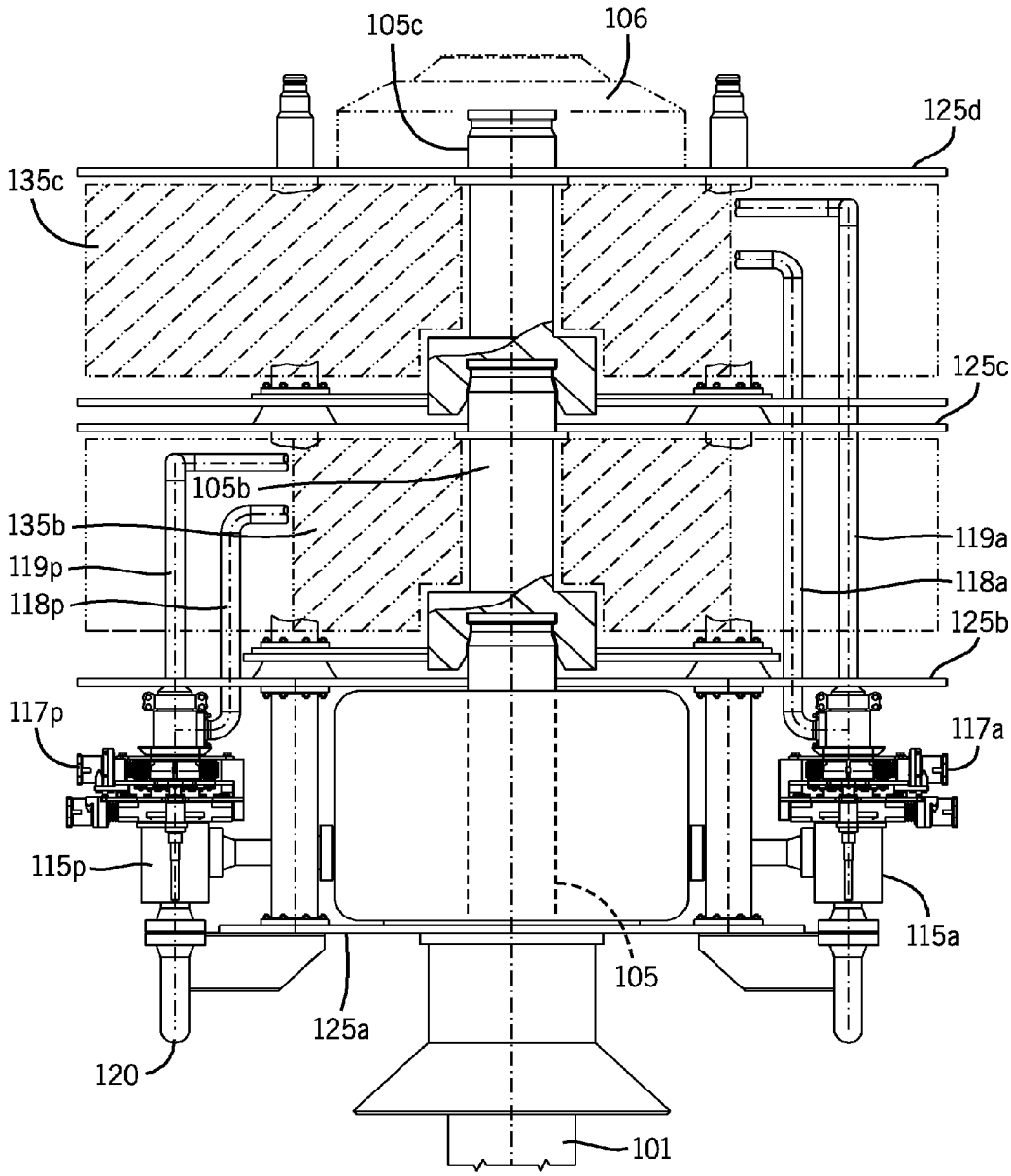
FIG. 8 is a side view of FIG. 6 tree with first and second fluid processing modules in place.

Processing units can be arranged in parallel or in series. FIGS. 6-8 show a further embodiment of a vertical tree. Like parts between the two embodiments have been allocated the same reference numbers, but the second embodiment's reference numbers have been increased by 100.

In the embodiment shown in FIGS. 6-8, the vertical tree has a central mandrel 100 with a production bore 101 and an annulus bore 102 (see FIG. 6). The production bore 101 feeds a production choke 116*p* in a production choke body 115*p* through a production wing branch 110, and the annulus bore 102 feeds an annulus choke 116*a* in an annulus choke body 115*a* through an annulus wing branch 111. The tree has a cap 106 to seal off the mandrel and the production and annulus bores, located on top of a second plate 125*b* disposed directly above a lower first plate 125*a* as previously described. The second plate 125*b* is supported by tubular posts 114*a*, and guide posts 114' extend from the upper surface of the second plate 125*b*. ROV controls are provided on a control panel 134 as with the first embodiment.

FIG. 8 shows a first processing module 135*b* disposed on the top of the second plate 125*b* as previously described. The first processing module 135*b* has a central axial space for the first mandrel extension conduit 105*b*, with the processing devices therein (e.g. a pump) displaced from the central axis as previously described. A second processing module 135*c* is located on top of the first, in the same manner as described with reference to the FIG. 5 embodiment. The second processing module 135*c* also has a central axial space for the second mandrel extension conduit 105*c*, with the processing devices packed into the second processing module 135*c* being displaced from the central axis as previously described. The second processing module 135*c* can comprise a chemical injection device. The second mandrel extension conduit 105*c* connects to the first 105*b* as previously described for the first embodiment.

The production fluids are routed from the production choke body 115*p* by a fluid diverter 117*p* as previously described through tubing 118*p* and 119*p* to the first processing module 135*b*, and back to the choke body 115*p* for onward transmission through the flowline 120. Optionally the treated fluids can be passed through other treatment modules arranged in series with the first module, and stacked on top of the second module, as previously described.

The fluids flowing up the annulus are routed from the annulus choke body 115*a* by a fluid diverter 117*a* as previously described through tubing 118*a* and 119*a* to the second processing module 135*c*, and back to the choke body 115*a* for onward transmission. Optionally the treated fluids can be passed through other treatment modules arranged in series with the second module, and stacked on top of the second or further modules, as previously described.

Figure 11:
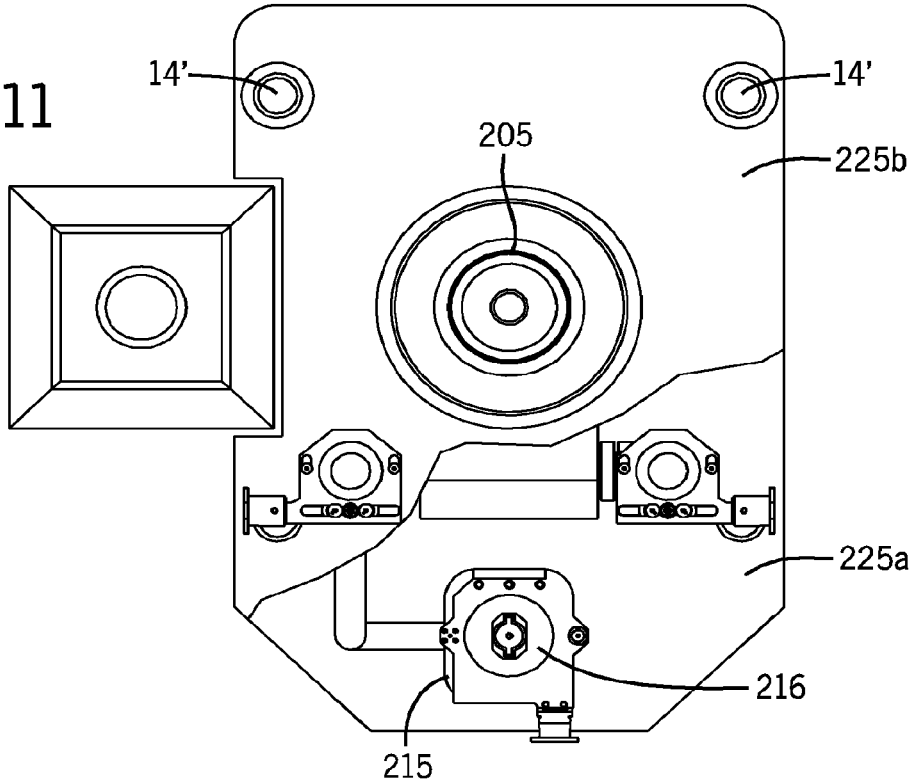
FIG. 11 shows a plan view of a further design of wellhead.
Figure 12:
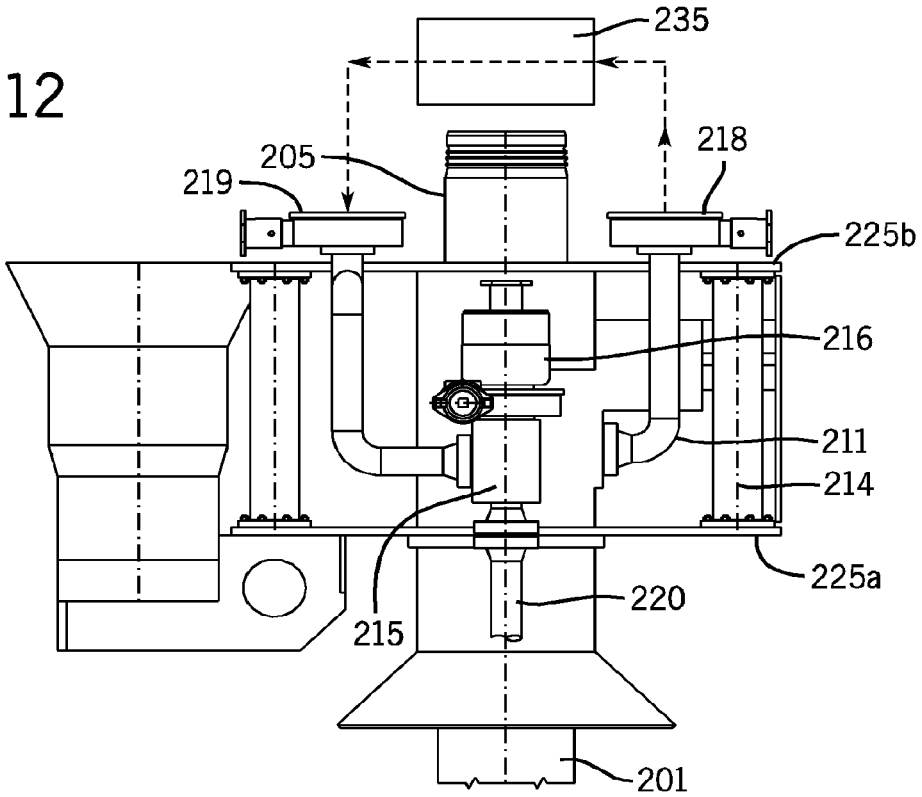
FIG. 12 shows a side view of the FIG. 11 wellhead, with a processing module.
Figure 13:
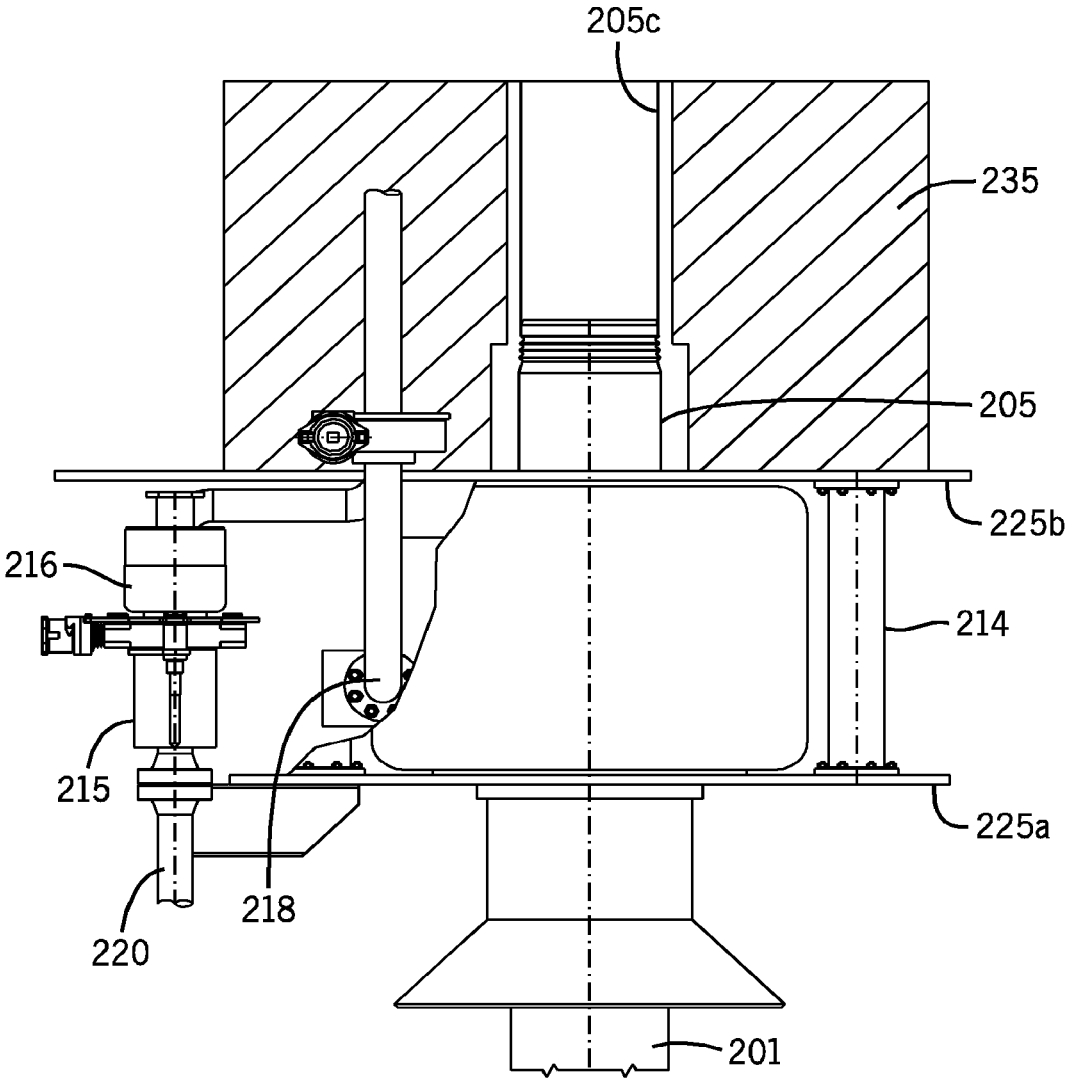
FIG. 13 shows a front facing view of the FIG. 11 wellhead.

FIGS. 11-13 show an alternative embodiment, in which the wellhead has stacked processing modules as previously described, but in which the specialized dual bore diverter 17 insert in the choke body 15 has been replaced by a single bore jumper system. In the modified embodiment shown in these figures, the same numbering has been used, but with 200 added to the reference numbers. The production fluids rise up through the production bore 201, and pass through the wing branch 211 but instead of passing from there to the choke body 215, they are diverted into a single bore jumper bypass 218 and pass from there to the process module 235. After being processed, the fluids flow from the process module through a single bore return line 219 to the choke body 215, where they pass through the conventional choke 216 and leave through the choke body outlet 220. This embodiment illustrates the application of the invention to manifolds without dual concentric bore flow diverters in the choke bodies.

Embodiments of the invention provide intervention access to trees or other manifolds with treatment modules in the same way as one would access trees or other manifolds that have no such treatment modules. The upper surfaces of the topmost module of embodiments of the invention are arranged to have the same footprint as the basic tree or manifold, so that intervention equipment can land on top of the modules, and connect directly to the bore of the manifold without spending any time removing or re-arranging the modules, thereby saving time and costs.

Modifications and improvements may be incorporated without departing from the scope of the invention. For example the assembly could be attached to an annulus bore, instead of to a production bore.

Any of the embodiments which are shown connected to a production wing branch could instead be connected to an annulus wing branch, or another branch of the tree, or to another manifold. Certain embodiments could be connected to other parts of the wing branch, and are not necessarily attached to a choke body. For example, these embodiments could be located in series with a choke, at a different point in the wing branch.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An assembly mountable to a subsea tree and a subsea production flowline, the subsea tree including a production line, comprising:

a module comprising a production line connector and a production flowline connector, the production line connector being disposed on a lateral branch of the subsea tree, operable for connection and fluid communication with said subsea tree and with said production flow line, respectfully, said module defining a fluid flow passageway therein, whereby said subsea tree is in fluid communication with said production flowline only through said module and only after said module is connected to said subsea tree and said production flowline.

2. The assembly of claim 1, wherein the module provides access to the subsea tree by a member not disposed on the module.

3. The assembly of claim 1, wherein the module includes a chemical injection device.

4. The assembly of claim 1 further including a choke on the production flowline for controlling fluids flowing through said fluid flow passageway.

5. An assembly mountable to a subsea tree and a subsea production flowline, the subsea tree including a production line, comprising:

a module comprising a production line connector and a production flowline connector, the production line connector being disposed on a lateral branch of the subsea tree, operable for connection and fluid communication with said subsea tree and with said production flow line, respectfully, said module defining a fluid flow passageway therein, whereby said subsea tree is in fluid communication with said production flowline only through said module and only after said module is connected to said subsea tree and said production flowline;

wherein said module includes a flow measuring device without a production wing valve on the module.

6. The assembly of claim 1 wherein said module includes a processing apparatus.

7. The assembly of claim 6 wherein the processing device comprises a pump, a process fluid turbine, an injection apparatus for injecting gas or steam a material injection apparatus, a chemical reaction vessel, a pressure regulation apparatus, a fluid riser, a measurement apparatus, a temperature measurement apparatus, a flow rate measurement apparatus, a constitution measurement apparatus, a consistency measurement apparatus, a gas separation apparatus, a water separation apparatus, a solids separation apparatus, a hydrocarbon separation apparatus, or a combination thereof.

8. A module to provide the only fluid communication between a subsea installation comprising a subsea tree and a production flowline, said module comprising a first connector for connecting to said subsea installation and a second connector for connecting to said production flowline, said module, when installed, forming a fluid flow passageway which connects between said subsea tree and said production flowline, wherein said first connector is disposed on a lateral branch of said subsea tree.

9. The module of claim 8 further comprising access to the subsea tree by a member not disposed on the module.

10. The module of claim 9 wherein the module includes a chemical injection apparatus.

11. The module of claim 8 wherein a choke on the production flowline controls fluids flowing within said fluid flow passageway.

12. A module to provide the only fluid communication between a subsea installation comprising a subsea tree and a production flowline, said module comprising a first connector for connecting to said subsea installation and a second connector for connecting to said production flowline, said module, when installed, forming a fluid flow passageway which connects between said subsea tree and said production flowline, wherein said first connector is disposed on a lateral branch of said subsea tree;

wherein said module includes a flow measuring device without a production wing valve on the module.

13. The module of claim 12 wherein said module includes a processing apparatus.

14. The module of claim 13 wherein the processing device includes at least one of the group consisting of a pump, a process fluid turbine, an injection apparatus for injecting gas or steam, a material injection apparatus, a chemical reaction vessel, a pressure regulation apparatus, a fluid riser, a measurement apparatus, a temperature measurement apparatus, a flow rate measurement apparatus, a constitution measurement apparatus, a consistency measurement apparatus, a gas separation apparatus, a water separation apparatus, a solids separation apparatus, a hydrocarbon separation apparatus, or a combination thereof.

15. A module for fluidly connecting a production line in a subsea tree and a production flowline to a processing device, said module comprising at least two connectors one for connecting to said production line in said subsea tree and another for connecting to said production flowline, said module, when installed, defining a fluid flow passageway which connects between said production line and said production flowline, and a choke to control fluid flow through said fluid flow passageway, wherein said choke and a production wing valve are disposed on the subsea tree.

16. A module for fluidly connecting a production line in a subsea tree and a production flowline to a processing device, said module comprising at least two connectors one for connecting to said production line in said subsea tree and another for connection to said production flowline, said module, when installed, defining a fluid flow passageway which connects between said production line and said production flowline, and a choke to control fluid flow through said fluid flow passageway, wherein said choke and a production wing valve are disposed on the subsea tree;

wherein the module accesses another module.

17. The module of claim 15 wherein the processing device includes at least one of the group consisting of a pump, a process fluid turbine, an injection apparatus for injecting gas or steam, a materials injection apparatus, a chemical reaction vessel, a pressure regulation apparatus, a fluid riser, a measurement apparatus, a temperature measurement apparatus, a flow rate measurement apparatus, a constitution measurement apparatus, a consistency measurement apparatus, a gas separation apparatus, a water separation apparatus, a solids separation apparatus, a hydrocarbon separation apparatus, or a combination thereof.

18. The module of claim 15 wherein the subsea tree and flowline have hubs for connecting to said two connectors.

19. A module for fluidly connecting a production line in a subsea tree and a production flowline to a processing device, said module comprising at least two connectors one for connecting to said production line in said subsea tree and another for connecting to said production flowline, said module, when installed, defining a fluid flow passageway which connects between said production line and said production flowline, and a choke to control fluid flow through said fluid flow passageway, wherein said choke and a production wing valve are disposed on the subsea tree;

wherein a choke controls fluids flowing within said fluid flow passageway and the module includes a flow measuring apparatus without a production wing valve on the module.

20. The assembly of claim 3, wherein chemicals are injected either through the production flow line or injected from the chemical injection device.

21. A subsea tree assembly mountable adjacent to a subsea production flowline, comprising:

a subsea tree with a production line therein, said subsea tree comprising an upper end;

a retrievable module comprising a production line connector and a production flowline connector operable for connection and fluid communication with said upper end of said subsea tree and with an upwardly directed end of said production flow line, respectfully, said retrievable module defining a fluid flow passageway therein, whereby said production line of said subsea tree is in fluid communication with said production flowline only through said retrievable module and only after said retrievable module is connected to said subsea tree and said production flowline;

an annulus connection between said retrievable module and an annulus line of said subsea tree, said annulus connection being the only annulus line fluid connection between said retrievable module and said annulus line of said subsea tree, and an annulus access valve for access to said annulus line located in said subsea tree, an annulus master valve for said annulus line located in said subsea tree, and an annulus line to production line crossover valve located in said subsea tree to provide a valve between said annulus line and subsea tree production line within said subsea tree.

22. The subsea tree assembly of claim 21, further comprising an intervention access passageway and an intervention package connection at an upper end thereof operable for connection to an intervention package.

23. The subsea tree assembly of claim 22, further comprising a valve within said intervention access passageway.

24. The subsea tree assembly of claim 21 wherein said retrievable module defines therein a choke within said fluid flow passageway.

25. The subsea tree assembly of claim 21 wherein said retrievable module comprises a subsea control module, said subsea control module comprising a plurality of electronic sensors.

26. The subsea tree assembly of claim 21 wherein said retrievable module comprises a flowmeter.

27. The subsea tree assembly of claim 21 wherein said retrievable module comprises an injection choke.

28. A retrievable module to provide the only fluid communication available between a subsea installation comprising a subsea tree and a production flowline, said retrievable module comprising:

a first connector for connecting to said subsea tree and a second connector for connection to said production flowline, said retrievable module, when installed, defining a fluid flow passageway which connects between said subsea tree and said production flowline; and an intervention access passageway and an intervention package connection positioned at an upper end of said retrievable module operable for connection to an intervention package.

29. The retrievable module of claim 28 further comprising a valve within said intervention access passageway.

30. The retrievable module of claim 28 wherein said retrievable module defines therein a choke within said fluid flow passageway.

31. The retrievable module of claim 28 wherein said retrievable module comprises a subsea control module, said subsea control module comprising a plurality of electronic sensors.

32. The retrievable module of claim 28 wherein said retrievable module comprises a flowmeter.

33. The retrievable module of claim 28 wherein said retrievable module comprises an injection choke.

34. A retrievable module for fluidly connecting between a production line in a subsea tree and a production flowline, said subsea tree and said retrievable module comprising:

at least two connections in said retrievable module for connection to said production line in a top of said subsea tree and an upwardly extending top of said production flowline, said retrievable module, when installed, defining a fluid flow passageway which connects between said production line and said production flowline, and a choke to control fluid flow through said fluid flow passageway;

an annulus connection between said retrievable module and an annulus line of said subsea tree, said annulus connection being the only annulus line fluid connection between said retrievable module and said annulus line of said subsea tree, and an annulus access valve for access to said annulus line located in said subsea tree, an annulus master valve for said annulus line located in said subsea tree, and an annulus line to production line crossover valve located in said subsea tree to provide a valve between said annulus line and a subsea tree production line within said subsea tree.

35. The retrievable module of claim 34 further comprising a subsea control module comprising electronic sensors.

36. The retrievable module of claim 34 further comprising a flow meter.

37. The retrievable module of claim 34 further comprising an intervention access passageway and an intervention package connection positioned at an upper end of said retrievable module operable for connection to an intervention package.

38. The retrievable module of claim 37 further comprising a valve within said intervention access passageway.

* * * * *